US006990784B2

(12) United States Patent
Lancaster, III et al.

(10) Patent No.: US 6,990,784 B2
(45) Date of Patent: Jan. 31, 2006

(54) APPARATUS AND METHOD FOR APPLYING CORNERBOARDS TO A LOAD

(75) Inventors: Patrick R. Lancaster, III, Louisville, KY (US); Phillip R. Moore, Mt. Washington, KY (US)

(73) Assignee: Lantech.com, LLC, Louisville, KY (US)

( * ) Notice: Subject to any disclaimer, the term of this patent is extended or adjusted under 35 U.S.C. 154(b) by 0 days.

(21) Appl. No.: 10/674,431

(22) Filed: Oct. 1, 2003

(65) Prior Publication Data

US 2004/0128949 A1 Jul. 8, 2004

Related U.S. Application Data

(62) Division of application No. 10/225,439, filed on Aug. 22, 2002, now Pat. No. 6,883,293.

(60) Provisional application No. 60/314,290, filed on Aug. 24, 2001.

(51) Int. Cl.
*B65B 11/00* (2006.01)
*B65B 61/00* (2006.01)

(52) U.S. Cl. ..... 53/399; 53/139.7; 53/410; 53/587; 53/588

(58) Field of Classification Search ..... 53/64, 53/139.6, 139.7, 168, 399, 410, 441, 465, 53/587, 556, 588
See application file for complete search history.

(56) References Cited

U.S. PATENT DOCUMENTS

| | | | | |
|---|---|---|---|---|
| 3,241,287 | A * | 3/1966 | Chundelak, Jr. | 53/139.6 |
| 3,271,925 | A * | 9/1966 | Francois | 53/139.6 |
| 4,897,980 | A | 2/1990 | Geyser et al. | |
| 5,226,280 | A | 7/1993 | Scherer et al. | |
| 5,289,668 | A | 3/1994 | Meyer | |
| 5,423,118 | A | 6/1995 | Lotti | |
| 5,535,572 | A | 7/1996 | Morantz et al. | |
| 5,546,730 | A | 8/1996 | Newell et al. | |
| 5,564,254 | A | 10/1996 | Thimon et al. | |
| 5,619,838 | A | 4/1997 | Kasel | |
| 6,178,721 | B1 | 1/2001 | Turfan | |
| 6,508,044 | B2 * | 1/2003 | Suolahti | 53/139.7 |

FOREIGN PATENT DOCUMENTS

| | | |
|---|---|---|
| EP | 0 562 399 | 9/1993 |

* cited by examiner

*Primary Examiner*—John Sipos
(74) *Attorney, Agent, or Firm*—Finnegan, Henderson, Farabow, Garrett & Dunner, LLP

(57) ABSTRACT

A method and apparatus for providing corners of a load with cornerboards prior to wrapping the load is provided. The method may include providing a load on a load transport surface, removing a cornerboard from within a magazine by a gripper, and transporting the cornerboard to a corner of the load with the gripper. Relative rotation may be provided between the stretch wrap packaging material dispenser and the load to wrap the stretch wrap packaging material around the cornerboard and the load. If the cornerboard is not pre-formed, it is folded prior to transport to the load. The cornerboard is secured to the corner of the load with the stretch wrap packaging material. In a preferred embodiment, four magazines and four grippers are provided, such that four cornerboards can be carried to the load at the same time.

24 Claims, 21 Drawing Sheets

APPARATUS AND METHOD FOR APPLYING CORNERBOARDS TO A LOAD

This application is a division of Ser. No. 10/225,439, filed Aug. 22, 2002 and now U.S. Pat. 6,883,293 which claims priority under 35 U.S.C. §119 based on U.S. Provisional Application No. 60/314,290, filed Aug. 24, 2001, the complete disclosure of which is incorporated herein by reference.

DESCRIPTION OF THE INVENTION

1. Field of the Invention

The present invention relates to a method and apparatus for placing cornerboards and wrapping a load. In particular, the present invention is directed to automatically placing cornerboards on the corners of a stacked load and wrapping stretch wrap packaging material around the load while the cornerboards are held in place.

2. Background of the Invention

Products are often stacked as a load on a pallet to simplify handling of the products. The pallet load is commonly wrapped with stretch wrap packaging material to maintain the stacked configuration. To protect the load during shipping and storage, particularly when the load is fragile and susceptible to indentation, top and bottom caps are provided on respective ends of the load, and corner protectors, i.e., cornerboards, are placed on the corners of the load. Care must be taken to avoid damaging the load during the process of positioning the protectors on the load.

Conventionally, this process of positioning the cornerboards is a time-consuming and expensive endeavor. If the process is performed manually, a cornerboard must first be positioned and temporarily secured on each corner of the load. The cornerboard is temporarily secured using tape, straps, or hand wrap film. After a cornerboard has been secured in position on each corner of the load, a top cap then may be placed on the load, if desired. The load is then transported to a stretch wrapping machine for stretch wrapping.

An automated apparatus may also be used to position cornerboards and top caps on the corner of a load. This type of apparatus stores a number of cornerboards vertically in a magazine. The vertical magazine feeds the cornerboard, via a series of belts or other moving parts, to a gripper placement device. In turn, the gripper placement device positions the cornerboard on a corner of the load by a series of positioning steps. The cornerboard may slip within the gripper placement device as it is removed from the vertical magazine, thereby creating a vertical misalignment between the cornerboard and the corner.

The apparatus may place cornerboards on the corners of the load one at a time. This procedure is relatively slow, and causes an increase in the wrapping cycle time. Alternatively, four magazines and four gripper placement devices may be provided to allow placement of all cornerboards on the load at approximately the same time, thereby reducing wrapping cycle time. However, because the magazines require a separate moving means to move the cornerboard between the magazine and the gripper placement device, the cost of such an apparatus is prohibitively high for most wrapping operations. In addition, if the length of the cornerboards used changes, it may be necessary to adjust the means for feeding the cornerboard to the gripper, causing a reduction in efficiency.

SUMMARY OF THE INVENTION

In accordance with the present invention, an apparatus and method to quickly, reliably, and inexpensively place corner boards on the corners of a load and to stretch wrap the load with the corner boards in place is provided.

According to one aspect of the present invention, a method of wrapping a load with packaging material is provided. The method includes providing a load having at least a first side and a second side on a load transport surface, providing at least one magazine containing cornerboards, transporting a cornerboard from the magazine in a direction parallel to a direction of movement of the load on the transport surface until a first leg of the cornerboard is proximate to the first side of a corner of the load, transporting the cornerboard in a direction transverse to the direction of movement of the load on the load transport surface until a second leg of the cornerboard is proximate to the second side of the corner of the load, dispensing packaging material from a packaging material dispenser, and moving the packaging material dispenser and the load relative to one another to wrap the packaging material around the cornerboard and load.

According to another aspect of the present invention, a method of wrapping a load with packaging material comprises providing a load on a load transport surface, providing at least one magazine containing cornerboards, retrieving a cornerboard from within the magazine with a gripper, transporting the cornerboard in a direction parallel to a direction of movement of the load on the load transport surface until a first leg of the cornerboard is proximate to a first side of a corner of the load, transporting the cornerboard in a direction transverse to the direction of movement of the load on the load transport surface until a second leg of the cornerboard is proximate to a second side of the corner of the load, dispensing packaging material from a packaging material dispenser, and moving the packaging material dispenser and the load relative to one another to wrap the packaging material around the cornerboard and load.

According to yet another aspect of the present invention, a method of wrapping a load with packaging material includes providing a load on a turntable, providing at least one magazine having a longitudinal axis and containing cornerboards adjacent the turntable, retrieving a cornerboard from within the magazine with a gripper, transporting the cornerboard in a direction parallel to the longitudinal axis of the magazine until a first leg of the cornerboard is proximate a first side of a corner of the load, transporting the cornerboard in a direction transverse to the first direction until a second leg of the cornerboard is proximate a second side of the corner of the load, holding the cornerboard adjacent to the load with a cornerboard holding device, dispensing packaging material from a packaging material dispenser, and rotating the turntable to wrap the packaging material around the cornerboard and load.

According to a further aspect of the present invention, a method of wrapping a load with packaging material includes providing a load on a load transport surface, providing at least one magazine containing cornerboards, retrieving a cornerboard from within the magazine, rotating the cornerboard, transporting the cornerboard from the magazine in a direction parallel to a longitudinal axis of the load transport surface until a first leg of the cornerboard is proximate a first side of a corner of the load, transporting the cornerboard in a direction transverse to the longitudinal axis of the load transport surface until a second leg of the cornerboard is proximate a second side of the corner of the load, dispensing packaging material from a packaging material dispenser, and moving the packaging material dispenser and the load relative to one another to wrap the packaging material around the cornerboard and load.

According to another aspect of the present invention, a method of wrapping a load with packaging material includes providing a load on a load transport surface, providing at least one magazine containing cornerboards, gripping a cornerboard within the magazine with a gripper, removing the cornerboard from the magazine by moving the gripper and cornerboard in a direction parallel to a longitudinal axis of the load transport surface, rotating the gripper and cornerboard, transporting the gripper and cornerboard in a direction parallel to the longitudinal axis of the load transport surface until a first leg of the cornerboard is proximate to a first side of a corner of the load, transporting the gripper and cornerboard in a direction transverse to the longitudinal axis of the load transport surface until a second leg of the cornerboard is proximate to a second side of the corner of the load, releasing the cornerboard from the gripper, dispensing packaging material from a packaging material dispenser, and providing relative movement between the packaging material dispenser and the load to wrap the packaging material around the cornerboard and load.

According to another aspect of the present invention, a method of wrapping a load with packaging material includes providing a load on a load transport surface, providing a dual magazine having a first magazine containing cornerboards of a first height and a second magazine of a second height, automatically selecting a height of cornerboards to be used for wrapping the load, retrieving a cornerboard of the selected height from the dual magazine, transporting the cornerboard to a corner of the load, dispensing packaging material from a packaging material dispenser, and providing relative movement between the packaging material dispenser and the load to wrap the packaging material around the cornerboard and load.

According to yet another aspect of the present invention, a method of wrapping a load with packaging material comprises providing a load on a load transport surface, providing at least one magazine containing unformed cornerboards, removing a cornerboard from within the magazine, folding the cornerboard, transporting the cornerboard to a corner of the load subsequent to folding the cornerboard, dispensing packaging material from a packaging material dispenser, and moving the packaging material dispenser and the load relative to one another to wrap the packaging material around the cornerboard and load.

According to another aspect of the invention, a method of wrapping a load with packaging material comprises providing a load on a load transport surface, holding an unformed cornerboard with a gripper, folding the unformed cornerboard, transporting the folded cornerboard in a direction parallel to a longitudinal axis of the load transport surface until a first leg of the cornerboard is proximate a first side of a corner of the load, transporting the folded cornerboard in a direction transverse to the longitudinal axis of the load transport surface until a second leg of the cornerboard is proximate a second side of the corner of the load, dispensing packaging material from a packaging material dispenser, and wrapping the packaging material around the cornerboard and load.

According to another aspect of the invention, an apparatus for wrapping a load with packaging material is provided. The apparatus includes a packaging material dispenser for dispensing packaging material, a load transport surface having a longitudinal axis, a cornerboard gripper movable in a first direction parallel to the longitudinal axis of the load transport surface and movable in a second direction transverse to the longitudinal axis of the load transport surface, and means for providing relative movement between the packaging material dispenser and the load to wrap packaging material around the cornerboard and load.

According to yet another aspect of the invention, an apparatus for wrapping a load with packaging material includes a packaging material dispenser for dispensing packaging material, at least one magazine having a longitudinal axis for containing cornerboards, a turntable for providing relative rotation between the packaging material dispenser and the load to wrap packaging material around at least one cornerboard and load, a cornerboard gripper movable in a first direction parallel to the longitudinal axis of the magazine and movable in a second direction transverse to the longitudinal axis of the magazine, and a cornerboard holding device for holding the cornerboard as the turntable rotates.

According to a further aspect of the present invention, an apparatus for wrapping a load with packaging material includes a packaging material dispenser for dispensing packaging material, a load transport surface having a longitudinal axis, a rotatable cornerboard gripper movable in a first direction parallel to the longitudinal axis of the load transport surface and movable in a second direction transverse to the longitudinal axis of the load transport surface, and means for providing relative movement between the packaging material dispenser and the load to wrap packaging material around the cornerboard and load.

According to another aspect of the present invention, an apparatus for wrapping a load with packaging material includes a packaging material dispenser for dispensing packaging material, a load transport surface having a longitudinal axis, a transport arm moveable in a first direction parallel to the longitudinal axis of the load transport surface and moveable in a second direction transverse to the longitudinal axis of the load transport surface, a gripper mounted on the transport arm and movable along a length of the transport arm, and means for providing relative movement between the packaging material dispenser and the load to wrap packaging material around the cornerboard and load.

According to another aspect of the invention, a method of wrapping a load with packaging material comprises providing a load on a load transport surface having a longitudinal axis, providing four magazines, each magazine containing cornerboards, wherein two magazines are positioned upstream of the load, one on either side of the load transport surface, and two magazines are positioned downstream of the load, one on either side of the load transport surface, transporting a cornerboard from each of the magazines in a direction parallel to the longitudinal axis of the load transport surface until a first leg of the cornerboard is proximate a first side of a corner of the load, transporting each of the cornerboards in a direction transverse to the longitudinal axis of the load transport surface until a second leg of the cornerboard is proximate a second side of the corner of the load, dispensing packaging material from a packaging material dispenser, and providing relative movement between the packaging material dispenser and the load to wrap the packaging material around the cornerboards and load.

According to another aspect of the invention, a method of wrapping a load with packaging material comprises providing a load on a load transport surface having a longitudinal axis, rotating a cornerboard until a first leg of the cornerboard is transverse to the longitudinal axis of the load transport surface and a second leg of the cornerboard is parallel to the longitudinal axis of the load transport surface, transporting the cornerboard in a direction parallel to the longitudinal axis of the load transport surface until the first leg of the cornerboard is proximate a first side of a corner of the load, transporting the cornerboard in a direction transverse to the longitudinal axis of the load transport surface until the second leg of the cornerboard is proximate a second side of the corner of the load, dispensing packaging material from a packaging material dispenser, and providing relative movement between the packaging material dispenser and the load to wrap the packaging material around the cornerboard and load.

According to yet another aspect of the invention, a method of wrapping a load with packaging material includes providing a load on a load transport surface having a longitudinal axis, folding an unformed cornerboard, rotating the folded cornerboard until a first leg of the cornerboard is transverse to the longitudinal axis of the load transport surface and a second leg of the cornerboard is parallel to the longitudinal axis of the load transport surface, transporting the folded cornerboard in a direction parallel to the longitudinal axis of the load transport surface until the first leg of the cornerboard is proximate a first side of a corner of the load, transporting the folded cornerboard in a direction transverse to the longitudinal axis of the load transport surface until the second leg of the cornerboard is proximate a second side of the corner of the load, dispensing packaging material from a packaging material dispenser, and providing relative movement between the packaging material dispenser and the load to wrap the packaging material around the cornerboard and load.

According to a further aspect of the present invention, an apparatus for wrapping a load with packaging material a packaging material dispenser for dispensing packaging material, a load transport surface having a longitudinal axis, four magazines, each magazine for containing cornerboards, wherein two magazines are positioned upstream of the load, one on either side of the load transport surface, and two magazines are positioned downstream of the load, one on either side of the load transport surface, four cornerboard grippers, each gripper movable in a first direction parallel to the longitudinal axis of the load transport surface and movable in a second direction transverse to the longitudinal axis of the load transport surface, and means for providing relative movement between the packaging material dispenser and the load to wrap packaging material around the cornerboard and load.

According to another aspect of the invention, a method of wrapping a load with packaging material comprises providing at least one magazine containing cornerboards, gripping a cornerboard in the at least one magazine with a gripper, moving the gripper and cornerboard out of the at least one magazine, transporting the gripper and cornerboard to a corner of the load, dispensing packaging material from a packaging material dispenser, and providing relative movement between the packaging material dispenser and the load to wrap the packaging material around the cornerboard and load.

According to another aspect of the invention, a method of wrapping a load with packaging material includes providing at least one magazine containing cornerboards, using a first drive to remove a cornerboard from the magazine, using a second drive to rotate the cornerboard, using the first drive to transport the cornerboard to a corner of the load, dispensing packaging material from a packaging material dispenser, and wrapping the packaging material around the cornerboard and load.

According to yet another aspect of the invention, an apparatus for wrapping a load with packaging material includes a packaging material dispenser for dispensing packaging material, a load transport surface, at least one magazine for containing cornerboards, means for gripping a cornerboard within the magazine and for transporting the cornerboard to a position proximate a corner of the load, and means for providing relative movement between the packaging material dispenser and the load to wrap packaging material around the cornerboard and load.

According to a further aspect of the present invention, an apparatus for wrapping a load with packaging material comprises a packaging material dispenser for dispensing packaging material, at least one magazine for containing cornerboards, a transport arm connected to a first drive, a gripper connected to a second drive and movable from within the magazine to a position proximate to a corner of the load, wherein the first drive moves the transport arm between the magazine and the load and the second drive moves the gripper between a first and second ends of the transport arm, and means for wrapping the packaging material around the cornerboard and load.

According to another aspect of the invention, an apparatus for wrapping a load with packaging material includes a packaging material dispenser for dispensing packaging material, at least one magazine for containing unformed cornerboards, means for folding an unformed cornerboard, means for transporting the folded cornerboard to a position proximate a corner of the load, and means for wrapping the packaging material around the cornerboard and load.

According to yet another aspect of the invention, a method of wrapping a load with packaging material includes providing at least one magazine containing cornerboards, moving a gripper and an unformed cornerboard out of a magazine for storing unformed cornerboards, folding the unformed cornerboard, transporting folded cornerboard to a corner of the load with the gripper, dispensing packaging material from a packaging material dispenser, and providing relative movement between the packaging material dispenser and the load to wrap the packaging material around the cornerboard and load.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present embodiment of the invention, examples of which are illustrated in the accompanying drawings. Wherever possible, the same reference numbers will be used throughout the drawings to refer to the same or like parts.

The present invention provides a method and apparatus for placing cornerboards on a load and for wrapping packaging material around the cornerboards and load. By way of example, the present invention obviates the problems associated with the prior art discussed in the Background of the Invention. Specifically, the present invention may improve cycle time by providing four separate magazines, which allow cornerboards to be placed substantially simultaneously on all corners of the load. The present invention may also substantially reduce the cost associated with devices having four magazines by eliminating the drive mechanism (s) used to feed cornerboards from the magazines to the grippers. The present invention may utilize the same drive to move the cornerboards from the magazine to the gripper and to move the gripper to the load to position the cornerboard.

As discussed herein, a corner of the load is formed where two sides, such as first and second sides, of the load meet. The corner may or may not be a right angle (ninety degrees), depending upon the type of load and the tightness of the packing of the load. The present invention is not limited to the illustrated type of corners, and may be used to provide cornerboards to corners of all sizes and dimensions, not only those that are ninety degrees.

Figure 1:
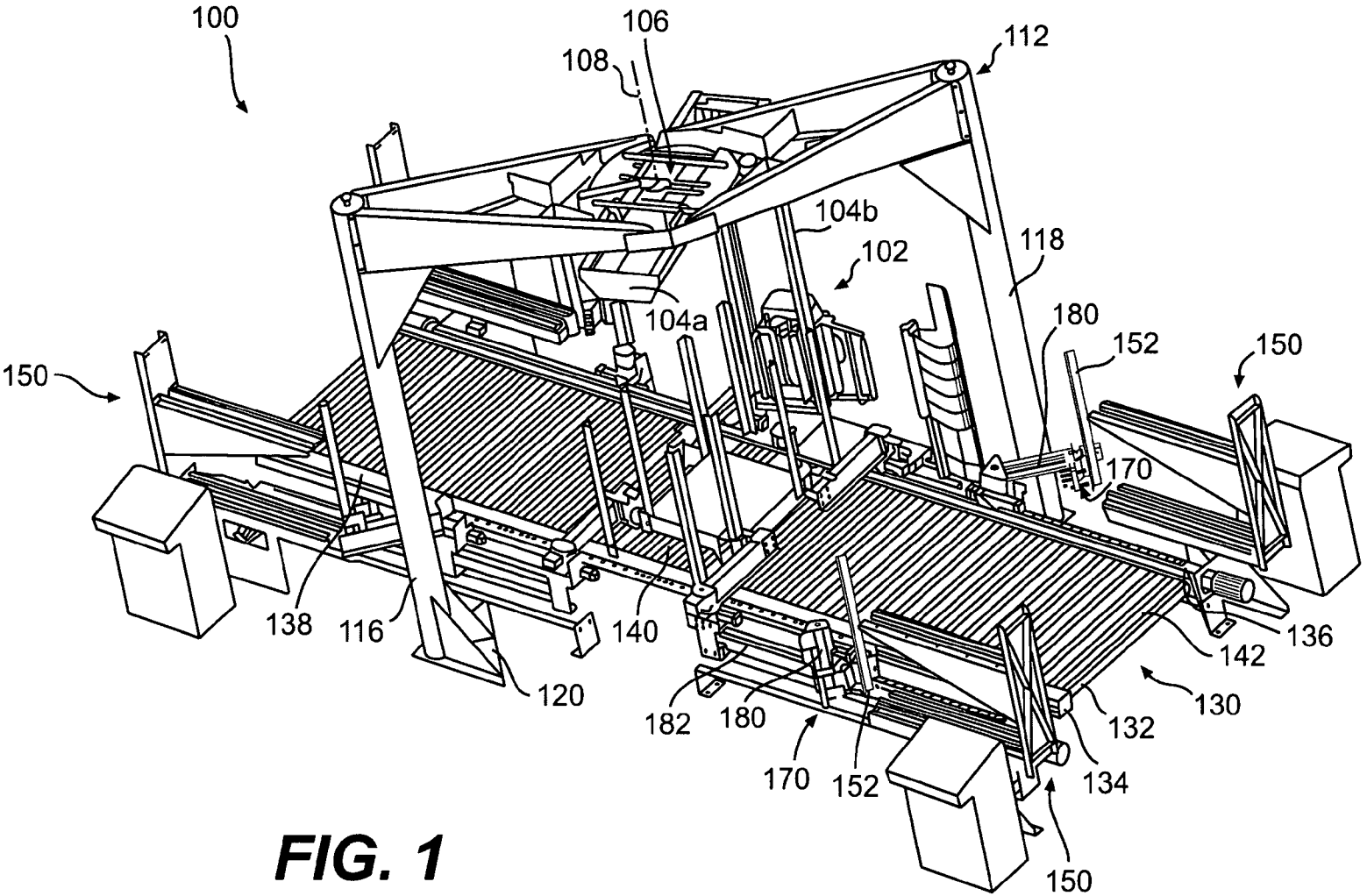
FIG. 1 is an isometric view of an embodiment of an apparatus for placing corner boards on a load and wrapping the load with the corner boards in place.

In accordance with one aspect of the present invention, an apparatus for wrapping a load with a packaging material is provided. As shown in FIG. 1, the apparatus for wrapping a load with stretch wrap packaging material includes a packaging material dispenser, a load transport surface, at least one magazine for containing cornerboards, a cornerboard gripper, and means for providing relative movement between the packaging material dispenser and the load.

Figure 2:
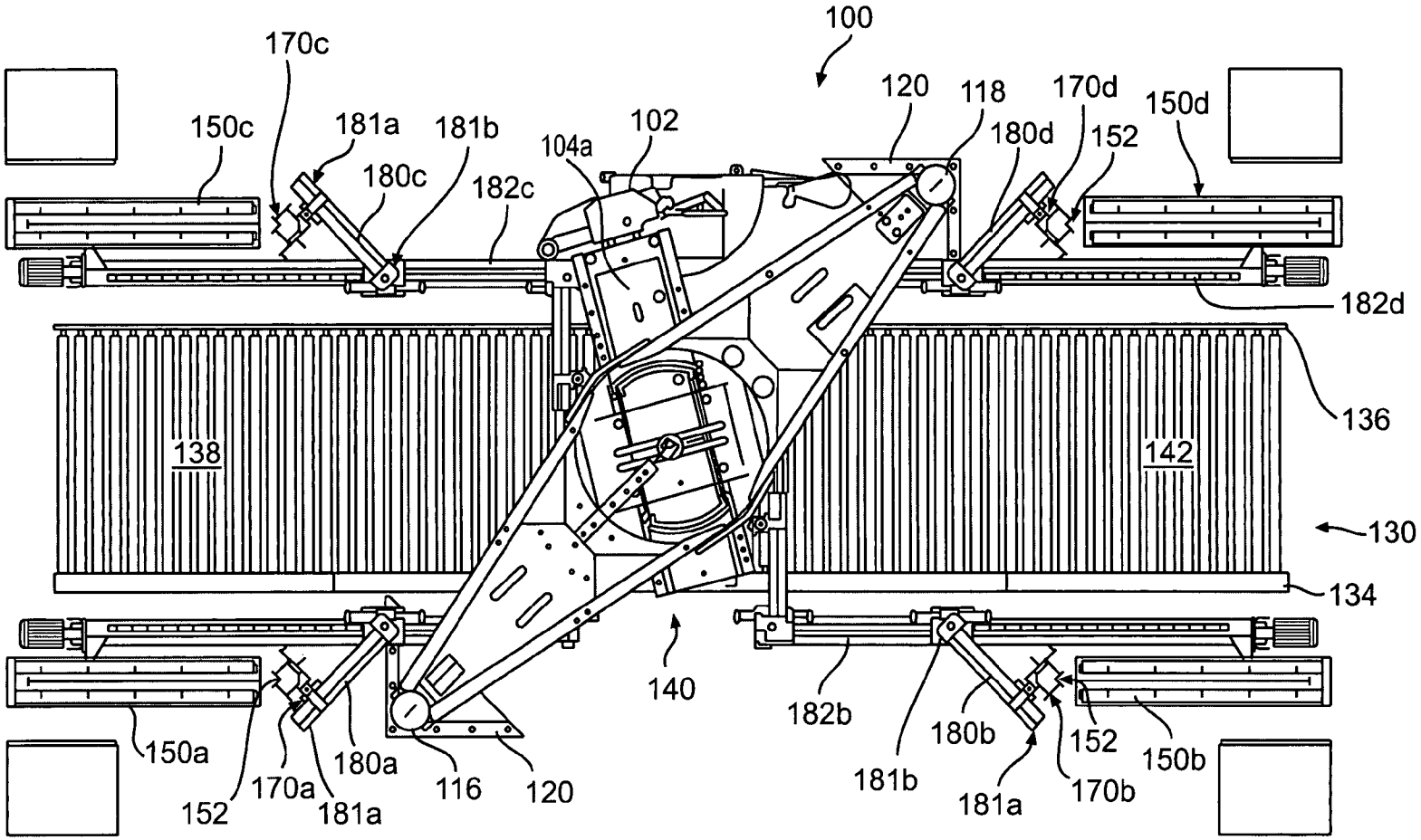
FIG. 2 is a top view of the apparatus of FIG. 1.
Figure 3:
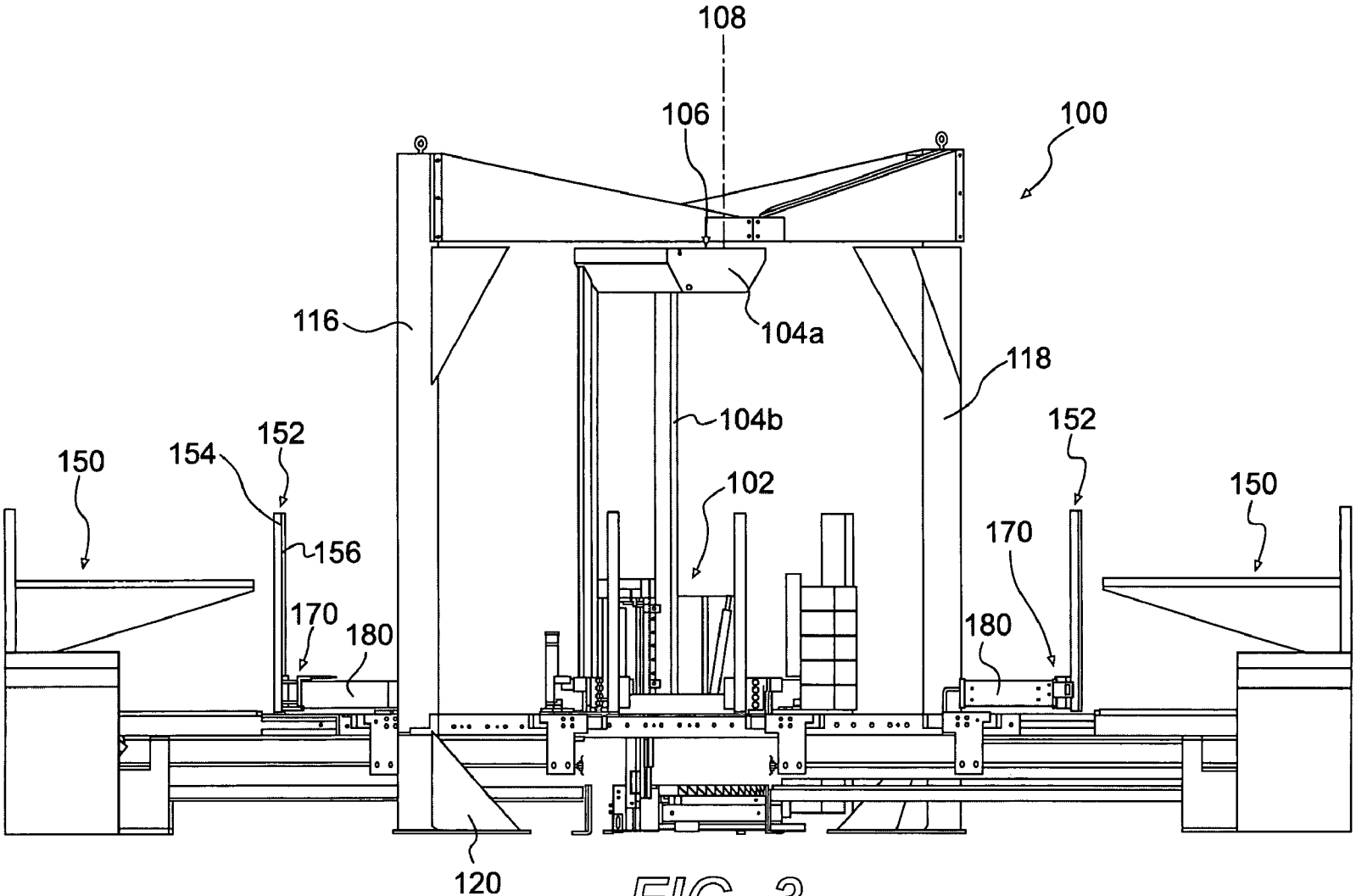
FIG. 3 is a side view of the apparatus of FIG. 1.
Figure 4:
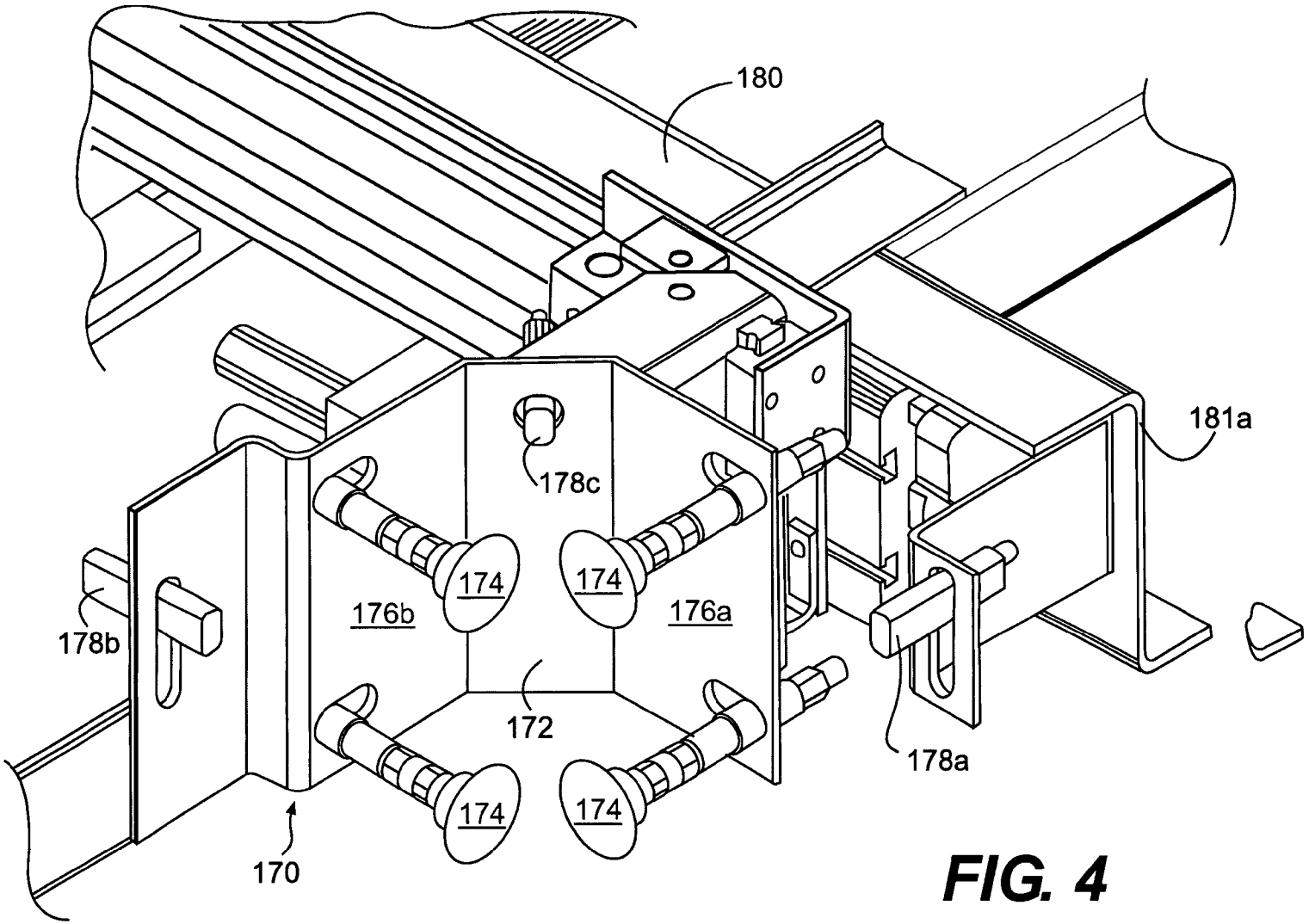
FIG. 4 is an isometric view of a transport arm and gripper according to the present invention.
Figure 5:
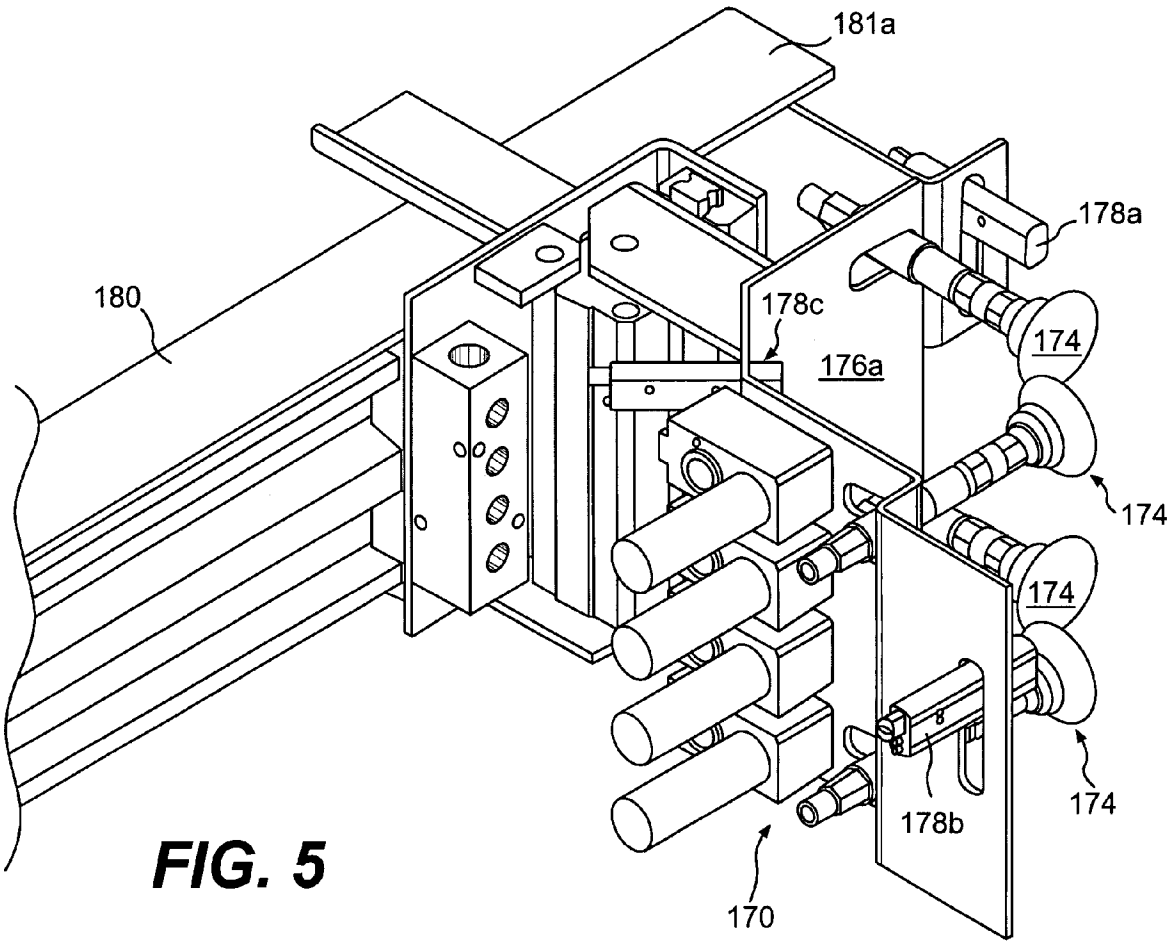
FIG. 5 is another isometric view of the transport arm and gripper of FIG. 4.
Figure 6:
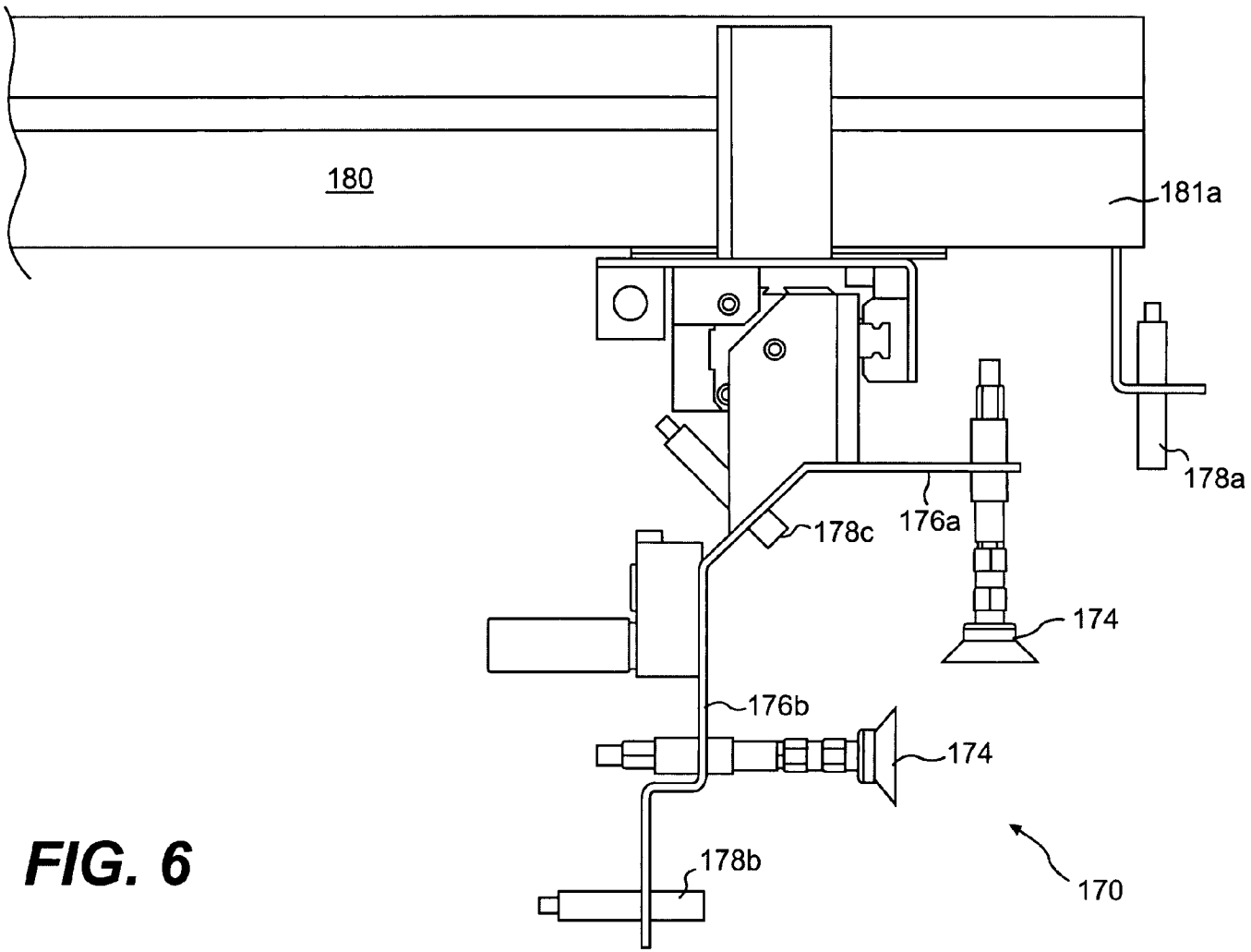
FIG. 6 is a top view of the transport arm and gripper of FIG. 4.
Figure 7:
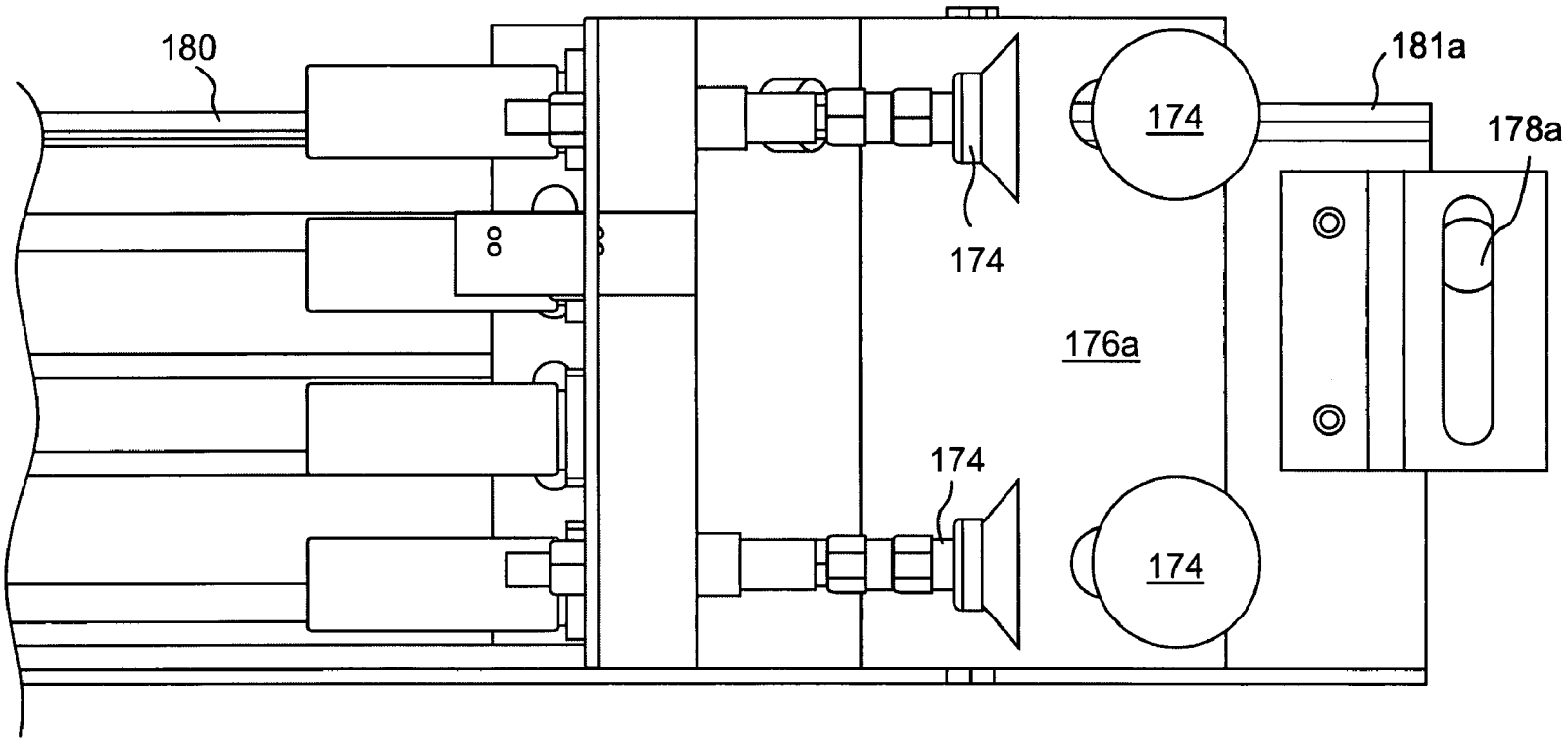
FIG. 7 is a side view of the transport arm and gripper of FIG. 4.

As embodied herein and shown in FIGS. 1–3, the present invention may include a packaging material dispenser rotatably mounted on a frame for dispensing stretch wrapping material. As shown in FIGS. 1–3, a frame 112 is provided. The frame 112 preferably includes a first leg 116 and a second leg 118. Both legs 116, 118 extend upward substantially vertically from a mounting surface, which can be a floor or some other structure built upon a floor. As shown in FIGS. 1–3, brackets 120 are provided for securing the legs 116, 118 to the mounting surface. The frame 112 may include a bridge that connects the legs 116, 118. Although it is preferred that frame 112 includes two legs as shown in FIGS. 1–3, it is possible that only one leg may be provided, or that more than two legs are provided.

Frame 112 rotatably supports a packaging material dispenser 102. As shown in FIGS. 1–3, dispenser 102 is mounted on a rotary arm 104 having a first portion 104*a* secured to a bearing member 106 and a second portion 104*b* holding the dispenser 102. The first portion 104*a* of the arm 104 is arranged so as to be rotatable about a vertically extending axis of rotation 108 to wrap packaging material around the sides of a load 110. Packaging material dispenser 102 may include a support for a roll of packaging material such as stretch wrap contained within a roll carriage. Dispenser 102 may also include a variety of rollers, optionally including prestretch rollers for stretching the packaging material longitudinally and/or transversely, to position, dispense, and stretch the packaging material as packaging material 114 is being dispensed from the roll of packaging material. In a preferred embodiment, stretch wrap packaging material is used, however, various other packaging materials such as netting, strapping, banding, or tape can be used as well.

A motor drive (not shown) is provided for providing relative rotation around the generally vertical axis 108 between the packaging material dispenser 102 and the load 110 to wrap packaging material 114 about the sides of load 110. The drive rotates rotatable arm 104 and dispenser 102 about a generally vertical axis 108 to wrap packaging material around the top and bottom of load 110.

According to another aspect of the invention, a load transport surface is provided. The load transport surface preferably includes a conveyor 130 extending between the first and second legs 116, 118 for transferring the load 110 to and from a wrapping area. As shown in FIGS. 1–3, conveyor 130 includes a plurality of rollers 132 mounted between opposite sides 134, 136 that each extend between the first and second legs 116, 118. The conveyor 130 moves the load 110 to and from the wrapping area. The load transport surface includes an infeed portion 138 for conveying the load to a wrapping portion 140, which supports the load while it is wrapped, and an output portion 142 for conveying the wrapped load 110 away from the wrapping portion. Preferably, the wrapping portion 140 comprises a portion of the conveyor 130 positioned below the bridge and located between legs 116, 118. Alternatively, the wrapping portion 140 may not include rollers, and instead may include a flat surface along which the load 110 can slide or be pushed. Also, wrapping portion 140 may include turntable surface, which may or may not include rollers to move the load. If a turntable is provided, a cornerboard holding device, such as a top platen, should be provided to hold the cornerboards in place as the turntable rotates.

Figure 8:
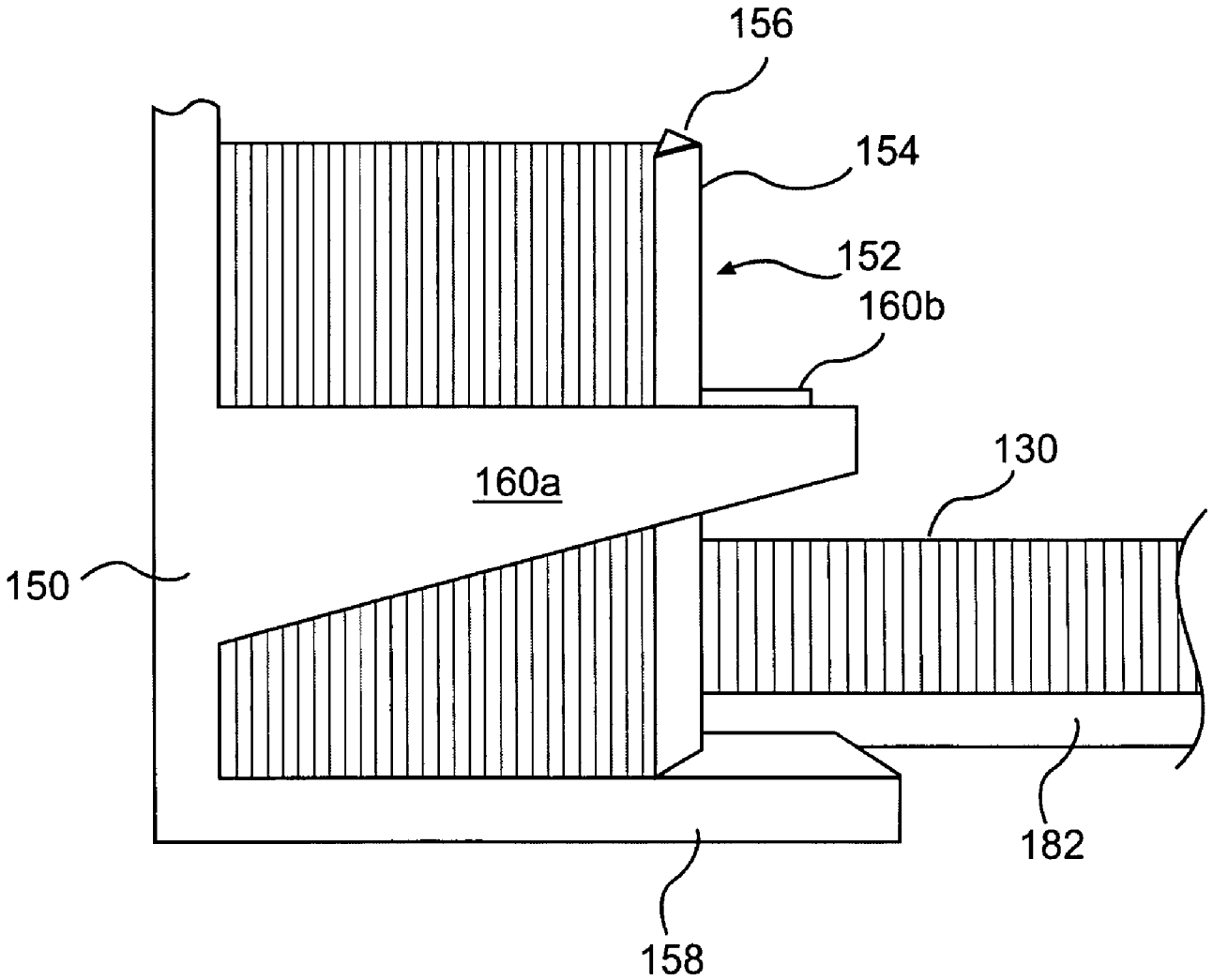
FIG. 8 is a side view of a magazine filled with pre-formed cornerboards according to the present invention.
Figure 9:
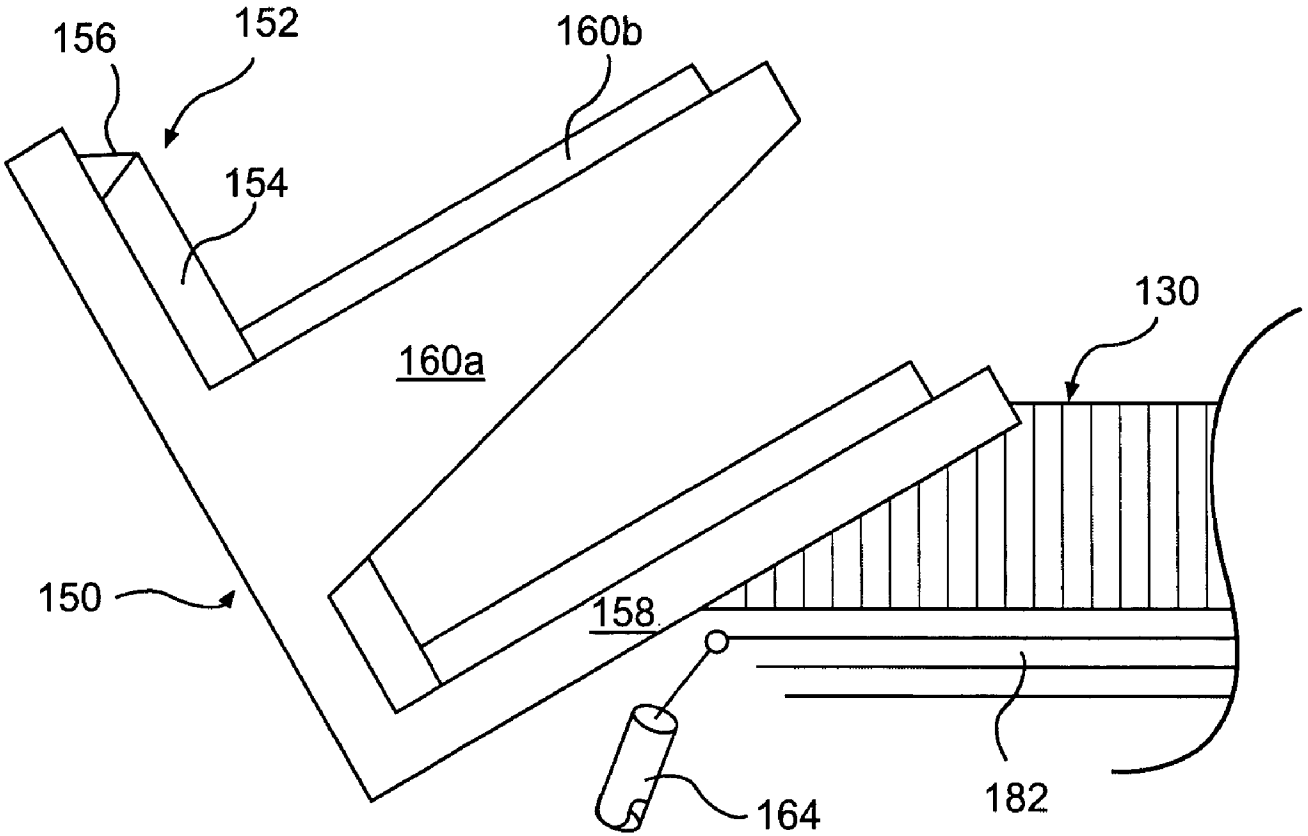
FIG. 9 is a side view of the magazine of FIG. 8 tilted into a loading position for receiving cornerboards.
Figure 10:
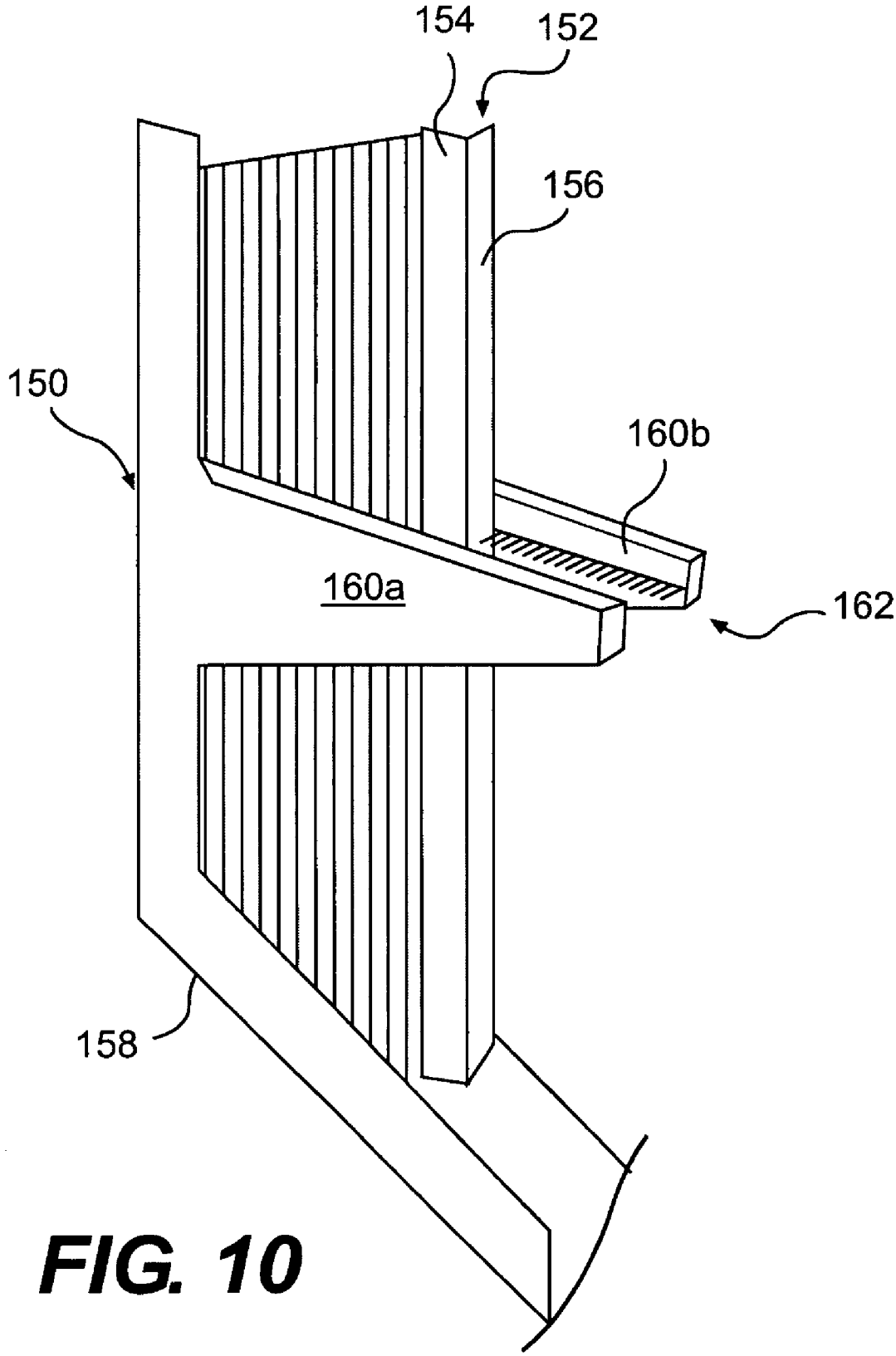
FIG. 10 is a front view of the magazine of FIG. 8.

According to another aspect of the present invention, at least one magazine for containing cornerboards is provided. As shown in FIGS. 8–10, a magazine 150 is provided. Magazine 150 is configured to hold cornerboards 152. Cornerboards 152 include a first leg 154 and a second leg 156 connected by a centerline. Cornerboards 152 may be pre-formed, i.e., bent such that the first leg 154 forms an angle of approximately ninety (90) degrees with the second leg 156. Cornerboards may also be pre-formed with angles of other than ninety degrees, if so desired. Magazine 150 is passive, i.e., it does not include any indexing means or feeding means for feeding or moving a cornerboard from within the magazine to outside the magazine. Alternatatively, cornerboards 152 may be unformed. Unformed cornerboards are substantially flat cornerboards that have not been pre-formed or that do not have a folded shape. They may include scoring or perforations to help the cornerboard fold along a predetermined line. Use of unformed cornerboards will be discussed later with respect to another embodiment of the present invention.

As embodied herein and shown in FIGS. 8–10, the magazine 150 may include a base 158 and one or more side rails 160*a*, 160*b*. Cornerboards 152 sit on base 158 between side rails 160*a*, 160*b* when stored in magazine 150. Side rails 160*a*, 160*b* may include a brush 162 or other means on an interior surface of rails 160*a*, 160*b* for maintaining cornerboards 152 in an upright position while in magazine 150, as shown in FIG. 10. Magazine 150 may be made of steel or any other suitable material.

As shown in FIG. 9, the magazine 150 may be movable between a dispensing position (FIG. 8) and a loading position (FIG. 9). In the dispensing position, the base 158 of the magazine 150 is substantially parallel with the load transport surface 130. In the loading position, magazine 150 is tilted to receive cornerboards 152. Magazine 150 is moved between the dispensing position and the loading position by a pneumatic cylinder 164. Actuation of the piston causes the magazine 150 to move from the dispensing position to the loading position.

Figure 11A:
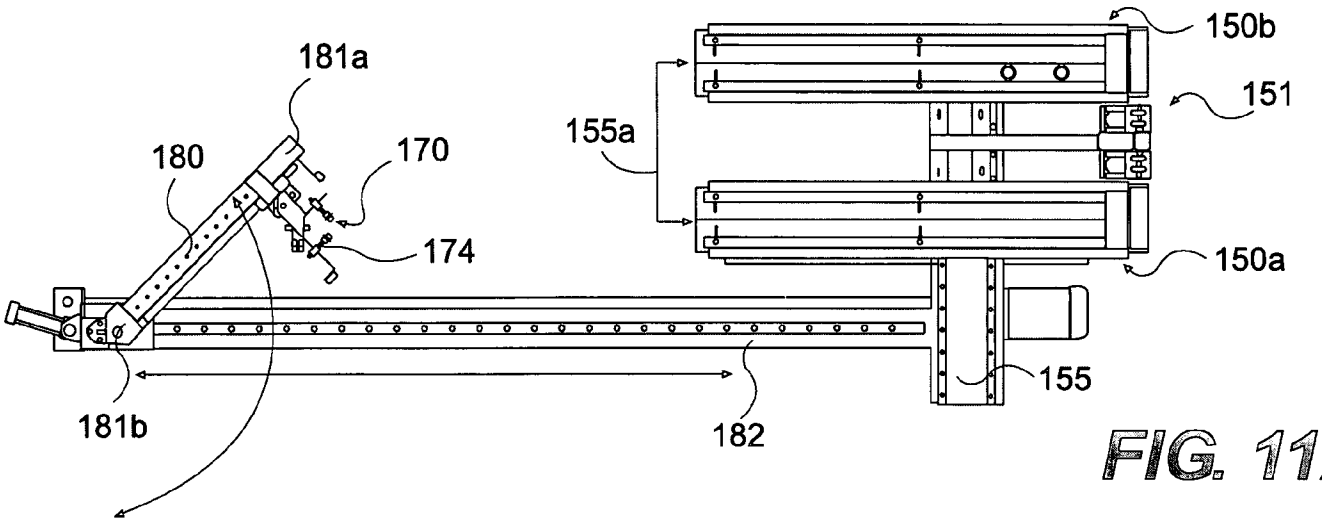
FIG. 11A is a top view of an alternate embodiment of a magazine according to another aspect of the present invention.
Figure 11B:
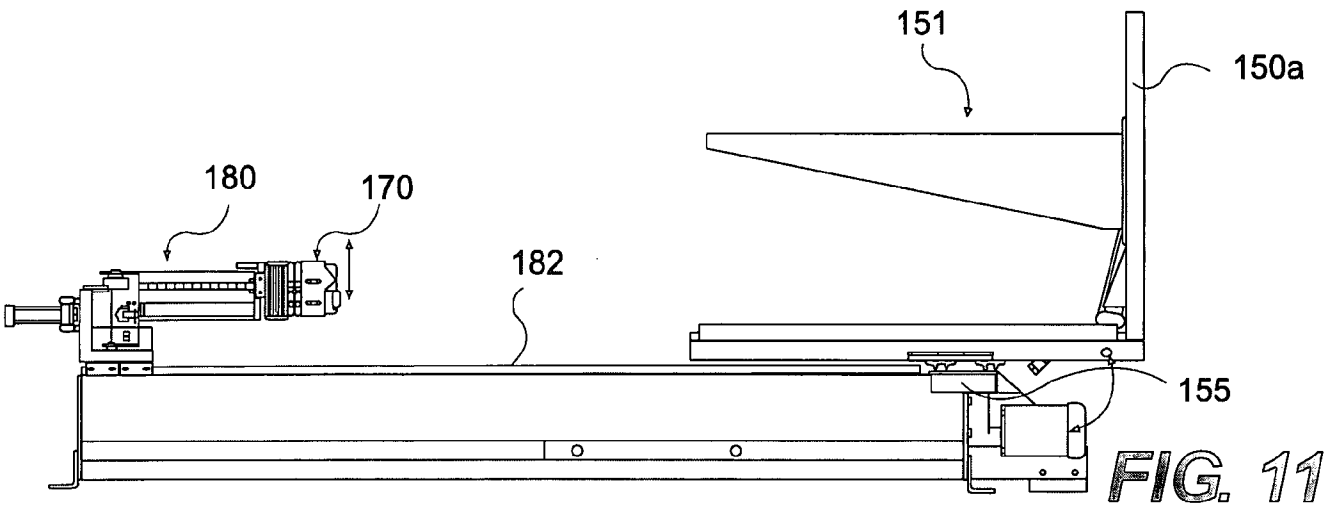
FIG. 11B is a side view of the magazine of FIG. 11A.

Alternatively, according to another aspect of the invention and as shown in FIGS. 11A and 11B, the magazine may be a dual magazine 151. As embodied herein, the dual magazine 151 may include a first magazine 150*a* and a second magazine 150*b*. Each magazine 150*a* and 150*b* may include a base 158 and side rails 160*a*, 160*b*. Cornerboards 152 sit on base 158 between side rails 160*a*, 160*b* when stored in magazine 150. Side rails 160*a*, 160*b* may include a brush 162 or other means on an interior surface of rails 160*a*, 160*b* for maintaining cornerboards 152 in an upright position while in magazine 150*a*, 150*b*. Dual magazine 151 may be made of steel or any other suitable material. Preferably, the first magazine 150*a* of dual magazine 151 includes cornerboards 152*a* having a first height and the second magazine 150*b* of dual magazine 151 includes cornerboards 152*b* having a second, different height. Alternatively, each magazine 150*a*, 150*b* of dual magazine 151 may include the same size cornerboards, thereby reducing the required frequency for restocking cornerboards in the magazines.

As discussed above with respect to magazine 150 and FIG. 9, each magazine 150*a* and 150*b* of dual magazine 151 is movable between a dispensing position and a loading position. In the dispensing position, the base 158 of each magazine 150*a*, 150*b* of dual magazine 151 is substantially parallel with the load transport surface 130. In the loading position, both magazines 150*a*, 150*b* of dual magazine 151 are tilted to receive cornerboards 152. Magazines 150*a*, 150*b* of dual magazine 151 are movable between the dispensing position and the loading position by a pneumatic cylinder 164. Actuation of the piston causes the dual magazine 151 to move from the dispensing position to the loading position.

In addition to moving between a loading position and a dispensing position, the magazines 150*a*, 150*b* of the dual magazine 151 are movable between a selected or active position and a non-selected or inactive position. Magazines 150*a*, 150*b* of dual magazine 151 are mounted on a rail portion 155. Magazines 150*a*, 150*b* are movable on rail 155 in a direction transverse to a drive shaft 182 and the load transport surface 130 as indicated by arrow 155*a*. The magazines 150*a*, 150*b* of dual magazine 151 are positioned a set distance apart from one another, and the magazines 150*a*, 150*b* shift simultaneously along rail 155 during actuation such that the set distance between magazines 150*a*, 150*b* does not change. Dual magazine 151 is movable on rail 155 by an air cylinder (not shown). At the beginning of each wrap cycle, a determination is made with regard to the height of cornerboards to be used to wrap the load. Once the determination is made, the magazine 151 is actuated by the air cylinder to move the appropriate magazine 150*a*, 150*b* into the selected/active position. The selected/active position places the magazine 150*a*, 150*b* in the path of a cornerboard gripper for removal of cornerboards from the magazine 150*a*, 150*b*. As shown in FIG. 11A, the magazine 150*a* of dual magazine 151 is in the active/selected position. To place magazine 150*b* of dual magazine 151 in the active/selected position, the dual magazine will shift along rail 155, such that the magazine 150*a* is on the opposite side of shaft 182 than shown in FIG. 11A, and such that magazine 150*b* is adjacent shaft 182.

According to one aspect of the present invention, a cornerboard gripper is provided. As embodied herein and shown in FIGS. 4–7, a cornerboard gripper 170 includes a body 172 and gripping elements for holding the cornerboard 152. Preferably, the gripping elements include suction cups 174. Cornerboard gripper body 172 preferably includes a first wall portion 176*a* and a second wall portion 176*b*. The first and second wall portions 176*a*, 176*b* may be perpendicular to one another, such that suction cups 174 extending through each wall portion are also at right angles to each other. This provides a preferred configuration for gripping and holding pre-formed cornerboards 152, wherein the first and second sides of the cornerboard form approximately a ninety degree angle. Alternatively, the configuration of the cornerboard gripper body 172 may be changed to accommodate different configurations of the cornerboard 152. The cornerboard gripper body 172 may be made from steel or other suitable materials.

As shown in FIGS. 4–7, cornerboard gripper 170 also may include proximity sensors 178. A first proximity sensor 178*a* may be provided on first wall portion 176*a* and a second proximity sensor 178*b* may be provided on second wall portion 176*b*. If desired, a third proximity sensor 178*c* may be provided between the two wall portions 176*a*, 176*b* to determine when a cornerboard is present in the cornerboard gripper 170. Preferably, one of the proximity sensors is provided on an end of a transfer arm which supports cornerboard gripper 170 rather than on the wall portion of the cornerboard gripper 170. The proximity sensors 178*a*, 178*b* determine when the cornerboard gripper 170 is proximate to a surface of the load. The sensors are preferably positioned to determine when the gripper 170 is proximate a front surface of the load and when the gripper 170 is proximate a side surface of the load. When the sensors sense that the first and second wall portions 176*a*, 176*b* are proximate surfaces of the load, the air flow to a rodless air cylinder which drives cornerboard gripper 170 along a transfer arm 180 is shut off. 991

As shown in FIGS. 1, 2, and 4–7, cornerboard gripper 170 is movably mounted on a transfer arm 180. Cornerboard gripper 170 is movable vertically with respect to transfer arm 180. Cornerboard gripper 170 is connected to linear bearing and driven by a rodless air cylinder to rise vertically approximately six to eight inches (6–8 in.) above the transfer arm. This allows the cornerboard gripper 170 to lift the cornerboard 152 from the base 158 of the magazine 150 prior to moving the cornerboard 152 out of the magazine, as will be described in further detail below. The cornerboard gripper 170 also may be driven horizontally by the rodless air cylinder along the length of transfer arm 180, from a free end of the transfer arm 180 to the end of transfer arm 180 mounted to a driving shaft. Cornerboard gripper 170 may be moveable in either direction along the length of transfer arm 180.

Transfer arm 180 may be mounted on a drive shaft which runs parallel to the load transfer surface 130. Cornerboard gripper 170 may be mounted on a free end 181*a* of transfer arm 180. As shown in FIGS. 1–3, the other end 181*b* of transfer arm 180 is mounted on polished shaft 182, which is preferably positioned between the load transfer surface 130 and magazine 150. Transfer arm 180 is positioned such that it can move cornerboard gripper 170 into magazine 150, above base 158 and below side rails 160*a*, 160*b*, until it comes into contact with a cornerboard 152. Transfer arm 180 also may be positioned such that it can move cornerboard gripper 170 to a position adjacent a front surface of the load 110. In order to move cornerboard gripper 170 between magazine 150 and load 110, the transfer arm 180 may be mounted on motor driven, polished shaft 182. The transfer arm 180 also may be mounted on a linear bearing and connected with a biased cam follower nut, which drives the transfer arm 180 forward with rotation of the shaft 182 in a first direction. Rotation of shaft 182 in an opposite direction drives transfer arm 180 in a reverse direction. Thus, movement of the transfer arm 180 on shaft 182 is much like a nut on a threaded shaft. However, because no threads are used, if the transfer arm encounters interference as it moves on shaft 182, the transfer arm 180 may slip on shaft 182 instead of continuing to move forward or binding up. This adds an extra measure of safety to the apparatus design. Other alternatives for driving the transfer arm 180 may include a threaded shaft or a chain and sprocket type arrangement or any other type of suitable arrangement to move the transfer arm 180 in both directions along the length of the load transport surface 130.

Transfer arm 180 may be mounted to be rotatable between a cornerboard pickup position and a cornerboard placement position. Preferably, rotation of transfer arm 180 is controlled by a linear air cylinder with precise limits of rotation. Alternatively, rotation of the transfer arm 180 may be controlled by a rotary air cylinder, hydraulics, electric motor, or other suitable means. The limits of rotation of transfer arm 180 are set dependent upon the type of cornerboard 152 used. For example, if the cornerboard 152 is pre-formed, the transfer arm 180 rotates 135 degrees. A rotation of 135 degrees will rotate a cornerboard 152 from a position in which the first and second legs 154, 156 are facing away from the load to a position in which the first leg 154 is parallel to a front surface of the load and the second leg 156 is parallel to a side of the load. Alternatively, if a different cornerboard 152 is used, the transfer arm 180 will rotate as necessary to align the cornerboard to face a corner of the load. Rotation of the transfer arm 180 serves to align the cornerboard gripper 170 and cornerboard 152 to face a corner of the load. After rotation, the transfer arm 180, the first wall portion 176*a* of the cornerboard gripper 170, and the first leg 154 of cornerboard 152 are perpendicular to a longitudinal axis 131 of the load transport surface and parallel to a front surface of the load 110. The second wall portion 176*b* of the cornerboard gripper 170 and second leg portion 156 of cornerboard 152 are parallel to the longitudinal axis 131 of the load transport surface and parallel to a side surface of the load 110.

The transfer arm 180 is movable on shaft 182 in a direction parallel to the longitudinal axis 131 of the load transport surface 130 and in a direction parallel to a direction of movement of the load on the load transport surface. The cornerboard gripper 170 is movable along transfer arm 180 in a direction perpendicular to the longitudinal axis of the load transport surface and in a direction perpendicular to the direction of movement of the load on the load transport surface.

According to another aspect of the invention, the apparatus 100 may be provided with other wrapping elements. As embodied herein and shown in FIGS. 1–3, various commonly used stretch wrapping elements may be mounted on the load transport surface 130. For example, a packaging material holder may be provided for gripping an end of the stretch wrapping material 114 during initiation and termination of a wrapping cycle. A cutter may also be provided for cutting the stretch wrapping material at the end of a wrapping cycle. The cutter may include a cutting blade or blades, or a heating element, as are commonly used. A wipedown device may be provided for attaching a cut end of stretch wrapping material to the load after being cut by the cutter.

In a preferred embodiment, as embodied herein and shown in FIGS. 1–3, the apparatus 100 may be provided with four magazines 150*a*, 150*b*, 150*c*, and 150*d*. Two of the magazines 150*a*, 150*b*, may be positioned on one side of conveyor 130, parallel to conveyor 130, one on either side of wrapping portion 140 of conveyor 130. In such an embodiment, one or more drive shafts 182*a*, 182*b*, 182*c*, 182*d* may be associated with each magazine, two provided on each side of conveyor 130. Magazines 150*c*, 150*d*, are positioned on the other side of conveyor 130, parallel to conveyor 130, one on either side of wrapping portion 140 of conveyor 130. Four transfer arms, 180, 180*a*, 180*b*, 180*c*, and 180*d* are also provided, each being mounted on a respective drive shaft 182*a*, 182*b*, 182*c*, and 182*d*. Each transfer arm 180*a*, 180*b*, 180*c*, and 180*d* has mounted thereon a cornerboard gripper 170*a*, 170*b*, 170*c*, and 170*d*, respectively.

According to an alternative embodiment of the present invention, a wrapping apparatus 200 may include a packaging material dispenser, at least one magazine for containing cornerboards, means for providing relative rotation between the load and the dispenser, and a cornerboard gripper.

Figure 12:
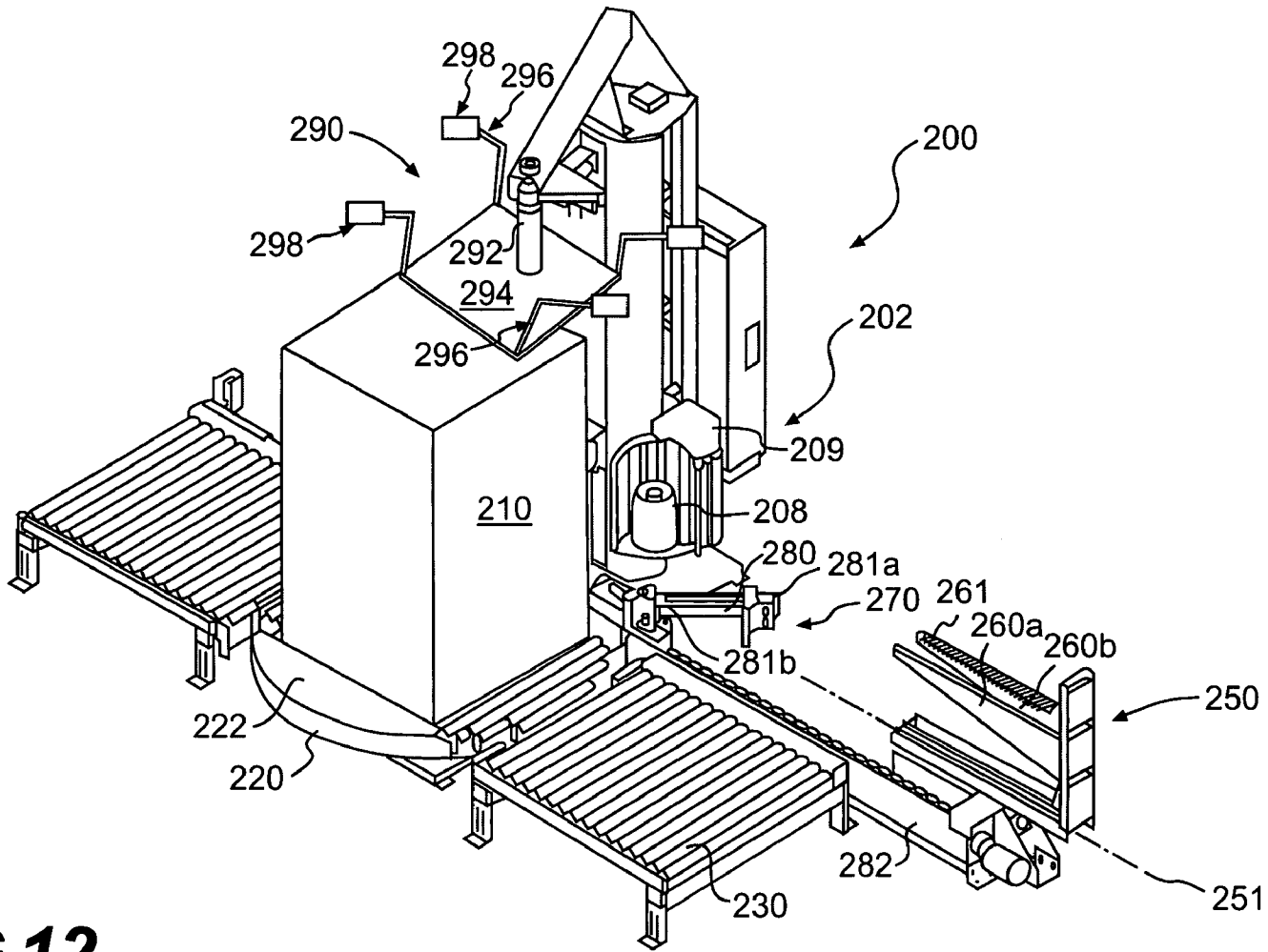
FIG. 12 is an isometric view of an alternative embodiment of an apparatus for placing corner boards on a load and wrapping the load with the corner boards in place.

As embodied herein and shown in FIG. 12, a packaging material dispenser 202 for dispensing packaging material may be provided. Packaging material dispenser 202 dispenses a sheet of packaging material 214 in a web form and may include a roll carriage 209 for supporting a roll of packaging material 208. Roll carriage 209 of dispenser 202 is mounted on and vertically moveable on a mast 204, shown in FIG. 12, to dispense packaging material 214 spirally about load 210 as rotation is provided between load 210 and dispenser 202. Roll carriage 209, as embodied herein and shown in FIG. 12, includes a support for the packaging material roll 208 and means for moving on mast 204. Alternatively, roll carriage 209 may include a container for holding packaging material roll 208, and a slit for dispensing packaging material 214 from packaging material roll 208.

In a preferred embodiment, stretch wrap packaging material is used. In the stretch wrapping art, stretch wrap packaging material is known to have a high yield coefficient to allow the material a large amount of stretch during wrapping. Various other packaging materials, generally not considered to be stretch wrap materials, such as netting, strapping, banding, and tape, can be used as well. Dispenser 202 may also include a variety of rollers, optionally including prestretch rollers for stretching the packaging material longitudinally and/or transversely, to position, dispense, and stretch the packaging material as packaging material 214 is being dispensed from the roll of packaging material.

According to another aspect of the invention, apparatus 200 includes means for providing relative rotation between the dispenser and the load to wrap packaging material around the load. As embodied herein and shown in FIG. 12, the means for providing relative rotation include a conventional turntable assembly 220 having a rotatable turntable 222. Turntable assembly 220 may be positioned proximate to a conveyor to receive a load 210 to be wrapped from a load building area, and/or a conveyor to remove the wrapped load from the turntable assembly 220. Load 210 is rotated by rotatable turntable 222 of turntable assembly 220 to provide relative motion between dispenser 202 and load 210.

Figure 13:
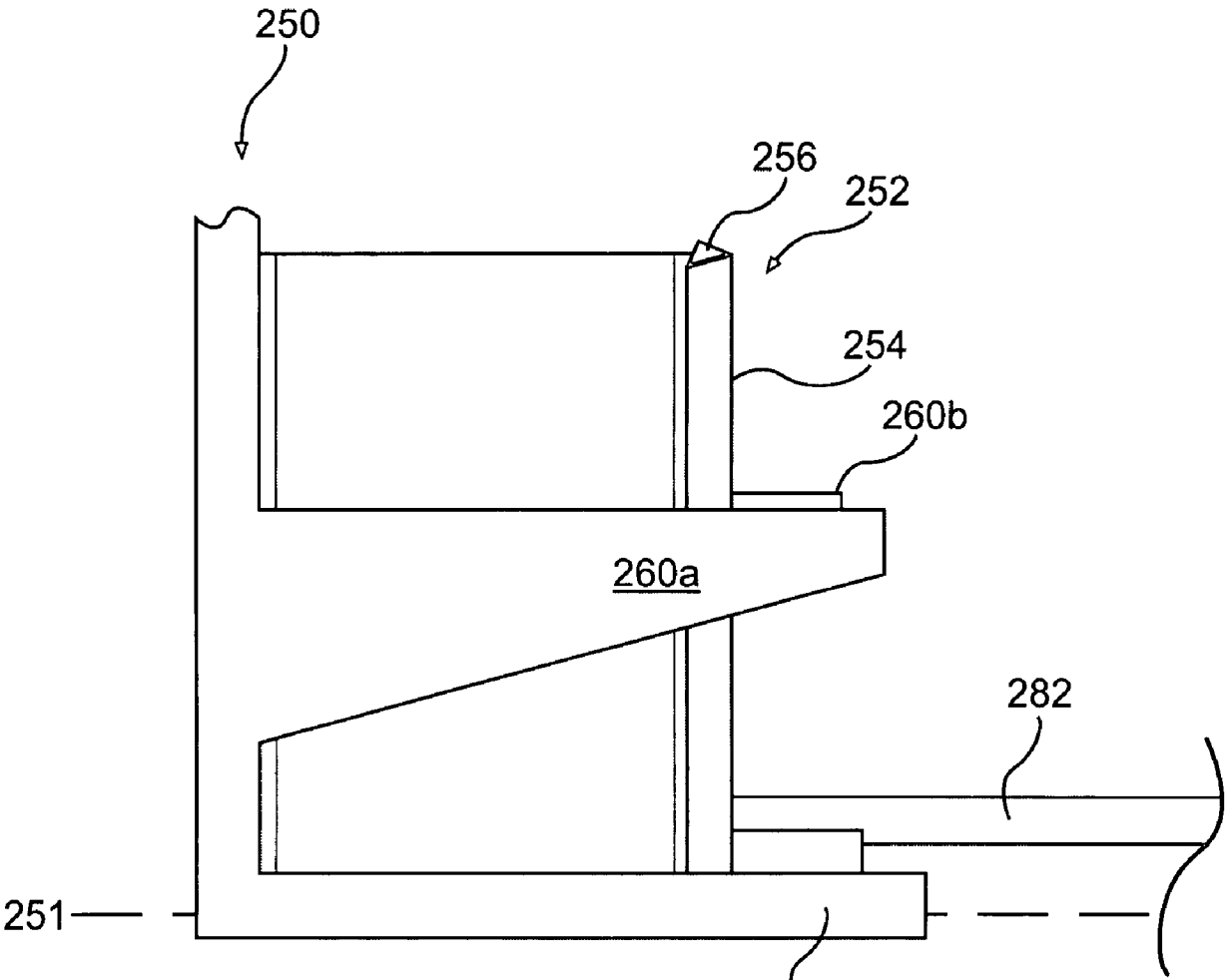
FIG. 13 is a close-up side view of the magazine of the apparatus in FIG. 12 filled with pre-formed cornerboards according to the present invention.

As shown in FIGS. 12 and 13, turntable assembly 220 may include an upper conveying surface with a plurality of powered rollers. As an alternative to the turntable embodiment, relative rotation may be accomplished by rotating dispenser 202 around a stationary load.

According to another aspect of the present invention, at least one magazine for containing cornerboards is provided. As shown in FIG. 12, a magazine 250 is provided. Magazine 250 may be configured to hold one or more cornerboards 252. Magazine 250 may be passive, i.e., it does not include any indexing means or feeding means for feeding or moving a cornerboard from within the magazine to outside the magazine. Magazine 250 is substantially identical to magazine 150 previously discussed with respect to the embodiment of FIGS. 8–10.

As embodied herein and shown in FIGS. 12 and 13, magazine 250 may include a base 258, a longitudinal axis 251, and side rails 260*a*, 260*b*. Cornerboards 252 sit on base 258 between side rails 260*a*, 260*b* when stored in magazine 250. Side rails 260*a*, 260*b* may include a brush 262 or other means on an interior surface of rails 260*a*, 260*b* for maintaining cornerboards 252 in an upright position while in magazine 250. Magazine 250 may be made of steel or any other suitable material. As discussed with respect to FIGS. 8–10, magazine 250 is moveable between a dispensing position and a loading position. Alternatively, as discussed with respect to FIGS. 11A and 11B, a dual magazine may be used.

According to one aspect of the present invention, a cornerboard gripper is provided. As embodied herein and shown in FIG. 12, a cornerboard gripper 270 is substantially identical to the cornerboard gripper 170 discussed with respect to FIGS. 4–7.

As shown in FIG. 12, cornerboard gripper 270 may be movably mounted on a transfer arm 280. Cornerboard gripper 270 may be movable vertically with respect to transfer arm 280. Cornerboard gripper 270 is connected to linear bearing and driven by a rodless air cylinder to rise vertically approximately four inches, such that it is approximately six inches above a load conveyor and/or turntable assembly 220. The height the gripper 270 is raised, and the distance between the cornerboard 252 and a load transport surface/turntable may be varied as necessary. This allows the cornerboard gripper 270 to lift the cornerboard 252 from the base 258 of the magazine 250 prior to moving the cornerboard 252 out of the magazine, as will be described in further detail below. The cornerboard gripper 270 is also driven horizontally by the rodless air cylinder along the length of transfer arm 280, from a free end 281*a* of the transfer arm 280 to the end of transfer arm 280 mounted to a driving shaft 282. Cornerboard gripper 270 is moveable in either direction along the length of transfer arm 280.

Transfer arm 280 is mounted on a drive shaft which is adjacent to turntable 220 and runs parallel to the longitudinal axis 251 of the magazine 250. Cornerboard gripper 270 is mounted on a free end 281*a* of transfer arm 280. The other end 281*b* of transfer arm 280 is mounted on polished shaft 282, which is preferably positioned between the turntable 220 and magazine 250. Transfer arm 280 is positioned such that it can move cornerboard gripper 270 into magazine 250, above base 258 and below side rails 260*a*, 260*b*, until it comes into contact with a cornerboard 252. Transfer arm 280 also may be positioned so that it can move cornerboard gripper 270 to a position adjacent a front surface of the load 210. In order to move cornerboard gripper 270 between magazine 250 and load 210, transfer arm 280 is mounted on polished shaft 282 which is motor driven. The transfer arm 280 is mounted, driven, and moveable in substantially the same manner as discussed with respect to transfer arm 180 of FIGS. 1–3. However, instead of moving in a direction parallel to a conveyor, transfer arm 280 moves in a direction parallel with the longitudinal axis 251 of magazine 250.

Transfer arm 280 is also mounted to be rotatable between a cornerboard pickup position and a cornerboard placement position. Rotation of the transfer arm 280, whether 135 degrees or 180 degrees, may serve to align the cornerboard gripper 270 and cornerboard 252. After rotation, the transfer arm 280 and the first leg 254 of cornerboard 252 are preferably perpendicular to the longitudinal axis 251 of magazine 250 and parallel to a front surface of the load 210. Additionally, the second leg portion 256 of cornerboard 252 may be parallel to the longitudinal axis 251 of the magazine 250 and parallel to a side surface of the load 210.

According to another aspect of the invention, a cornerboard holding device may be provided. Because the turntable rotates to provide relative rotation between the load 210 and the packaging material dispenser 202, the cornerboard gripper 270 may not hold the cornerboard 252 onto the load while it is secured to the load by the packaging material. Thus, as embodied herein and shown in FIG. 12, a cornerboard holding device may include a top platen 290. Top platen 290 preferably includes a shaft 292, a top platen pad 294, and arms 296. Preferably, top platen pad 294 is square or rectangular in shape, having four corners. An arm 296 is preferably pivotably connected via connection 297 to each corner of the top platen pad 294. Each arm 296 includes a hand 298 on a distal end thereof. Hands 298 are moveable on arms 296 between an engaging position and a non-engaging position. Once a cornerboard 252 is placed on or near a corner of the load 210, an arm 296 is actuated to pivot from the non-engaging position to the engaging position, bring hand 298 into contact with cornerboard 252 to hold cornerboard 252 against the load 210. Preferably, each arm 296 is individually actuatable to move from the non-engaging position to the engaging position to engage a corner of the load after a cornerboard 252 is placed on the corner of the load 210. Top platen 290 rotates with load 210 such that the cornerboards 252 are held in place on load 210 while the load rotates and is wrapped. As the load is wrapped, the packaging material 214 holds the cornerboards 252 in place, allowing the hands 298 to be disengaged. Alternatively, hands 298 may be replaced by panels or other means suitable for holding the cornerboards on the load prior to wrapping.

According to an alternative embodiment of the present invention, a wrapping apparatus 300 includes a packaging material dispenser, a load transport surface, at least one magazine for containing unformed cornerboards, means for folding an unformed cornerboard, means for transporting at least one cornerboard to a load, and means for providing relative movement between the packaging material dispenser and the load.

Figure 14:
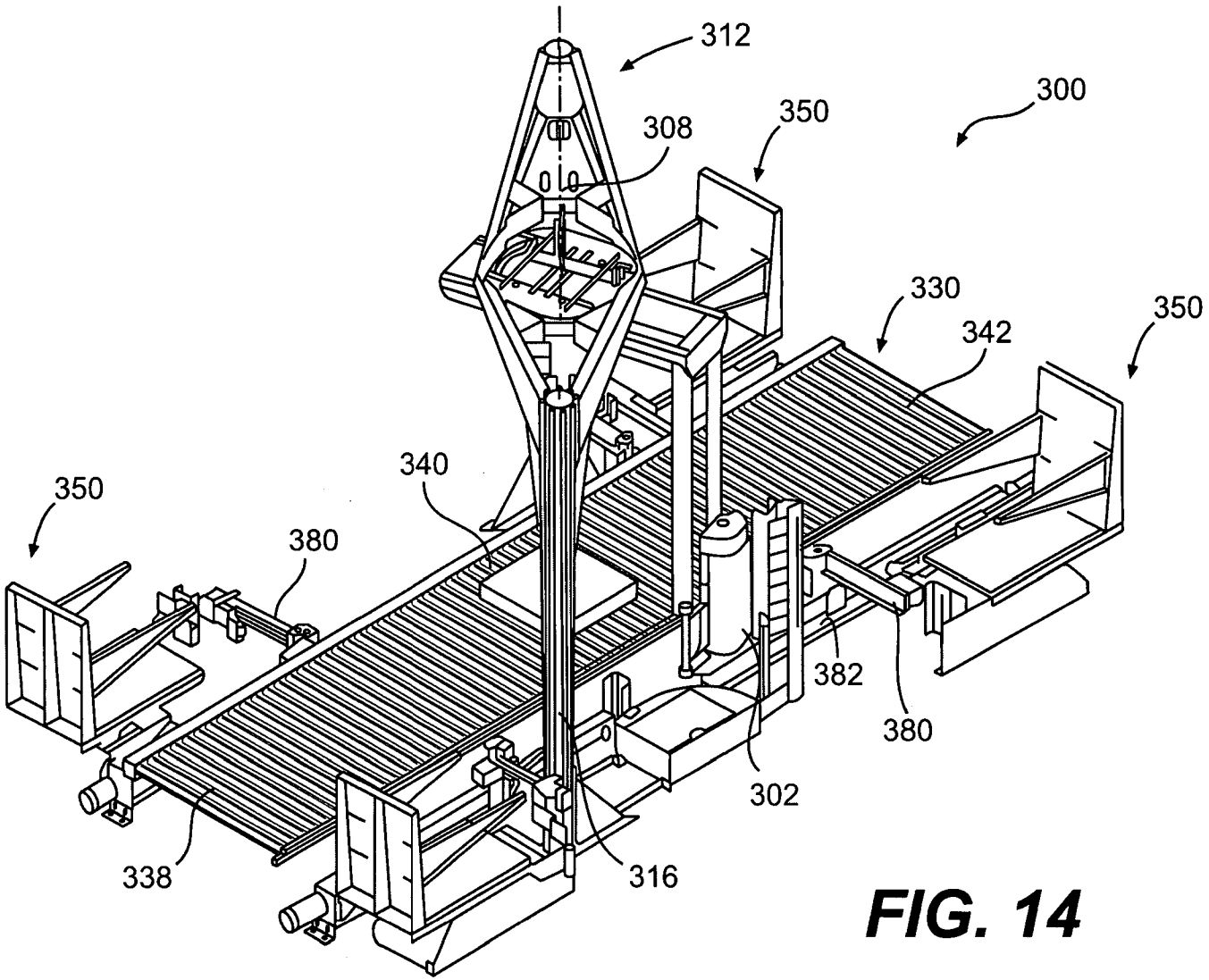
FIG. 14 is an isometric view of another alternate embodiment of an apparatus for placing corner boards on a load and wrapping the load with the corner boards in place.
Figure 15:
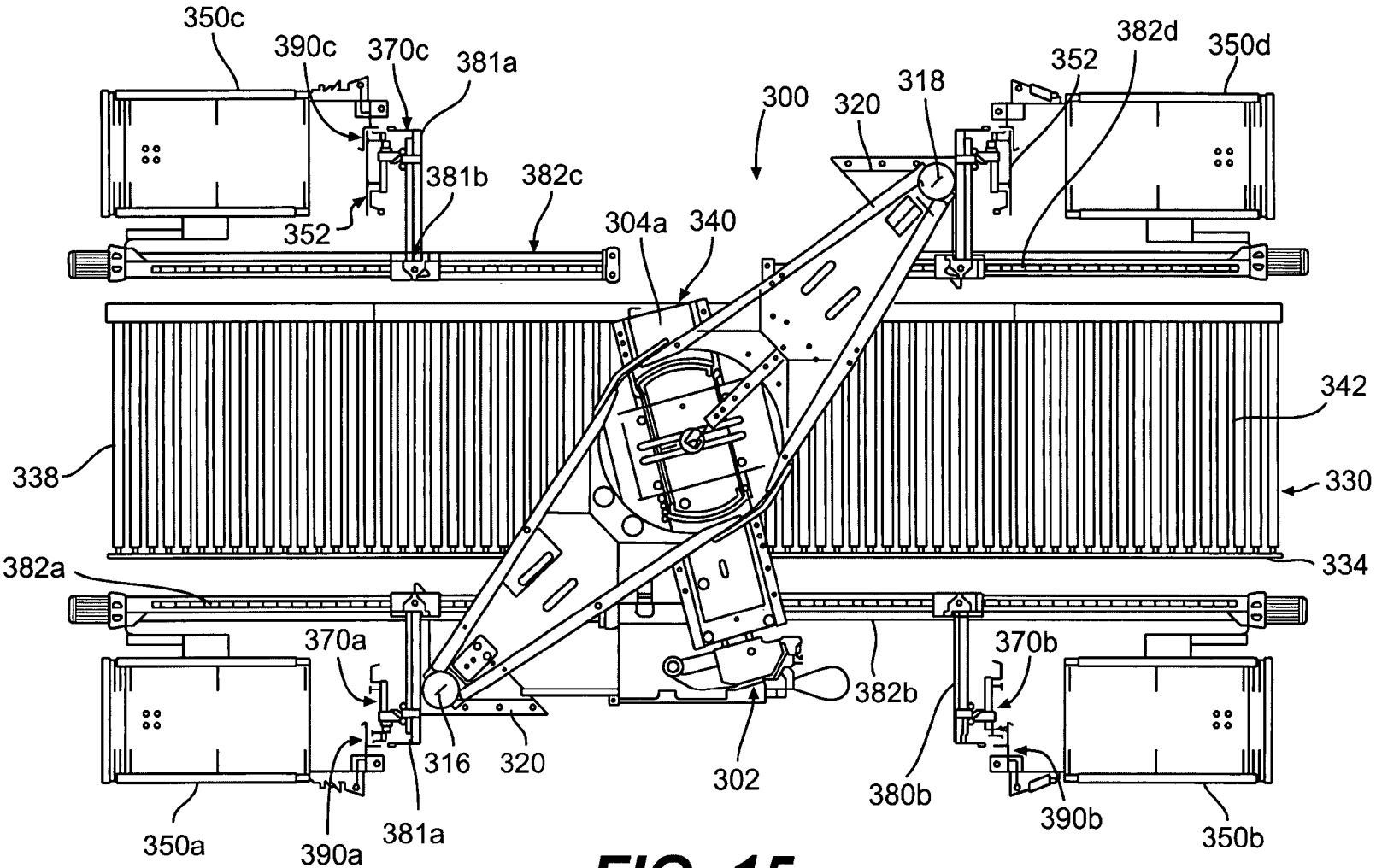
FIG. 15 is a top view of the apparatus of FIG. 14.
Figure 16:
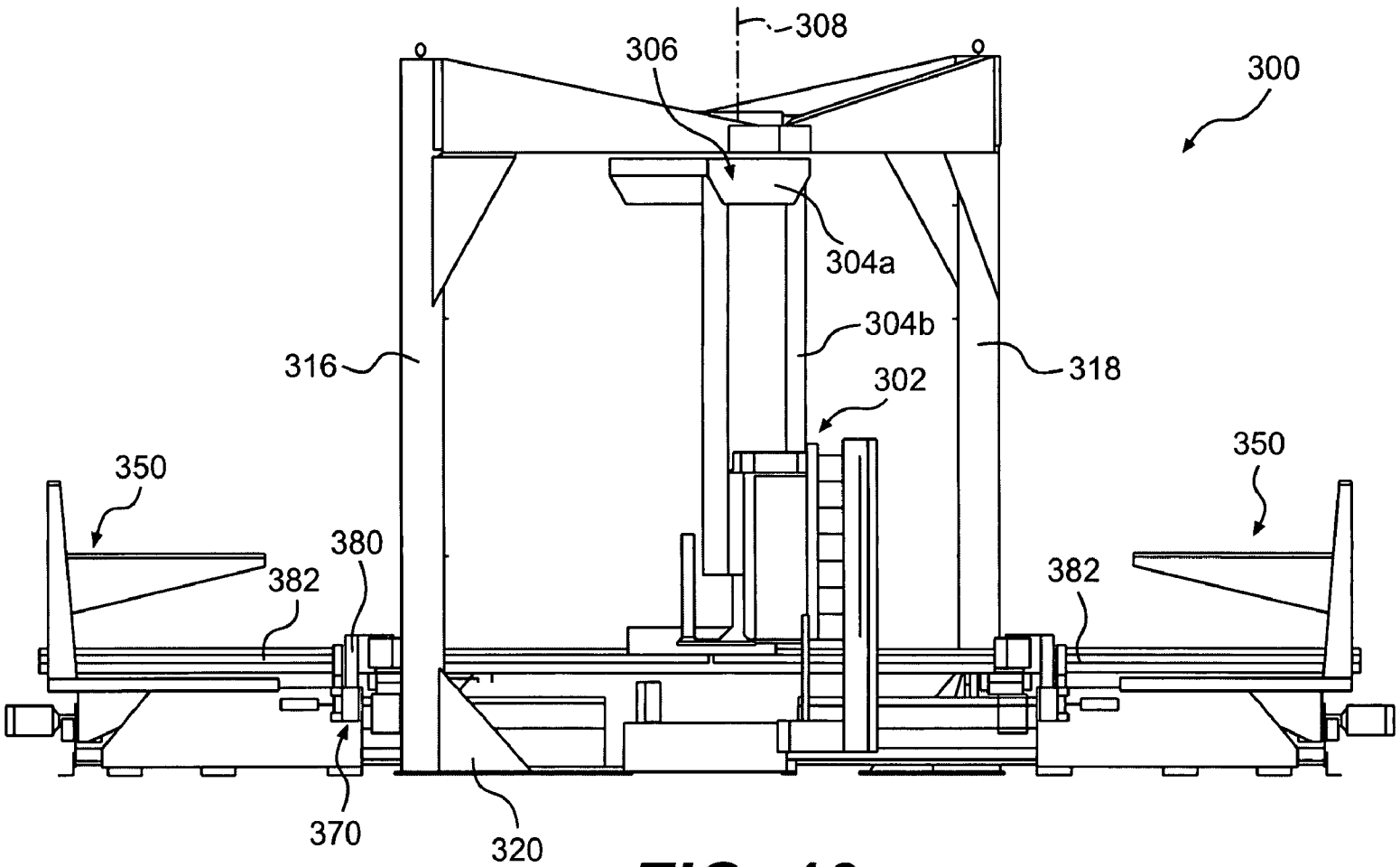
FIG. 16 is a side view of the apparatus of FIG. 14.

As embodied herein and shown in FIGS. 1–3, the present invention includes a packaging material dispenser rotatably mounted on a frame for dispensing stretch wrapping material. As shown in FIGS. 14–16, a frame 312 is provided. The frame 312 preferably includes a first leg 316 and a second leg 318. Both legs 316, 318 extend upward substantially vertically from a mounting surface, which can be a floor or some other structure built upon a floor. As shown in FIGS. 14–16, brackets 320 are provided for securing the legs 316, 318 to the mounting surface. The frame 312 may include a bridge that connects the legs 316, 318. Although it is preferred that frame 312 includes two legs as shown in FIGS. 14–16, it is possible that only one leg may be provided, or that more than two legs are provided.

Frame 312 rotatably supports a packaging material dispenser 302. As shown in FIGS. 14–16, the dispenser 302 is mounted on a rotary arm 304 having a first portion 304*a* secured to a bearing member 306 and a second portion 304*b* holding the dispenser 302. The first portion 304*a* of the arm 304 is so as to be rotatable about a vertically extending axis of rotation 308 to wrap packaging material around the sides of a load 310. Packaging material dispenser 302 includes a support for a roll of packaging material, such as stretch wrap, contained within a roll carriage, and may also include a variety of rollers, optionally including prestretch rollers for stretching the packaging material longitudinally and/or transversely, to position, dispense, and stretch the packaging material as packaging material 314 is being dispensed from the roll of packaging material.

A motor drive (not shown) is provided for providing relative rotation around the generally vertical axis 308 between the packaging material dispenser 302 and the load 310 to wrap packaging material 314 about the sides of load 310. The drive rotates the rotatable arm 304 and the dispenser 302 about generally vertical axis 308 to wrap packaging material around the top and bottom of load 310.

According to another aspect of the invention, a load transport surface is provided. The load transport surface preferably includes a conveyor 330 extending between the first and second legs 316, 318 for transferring the load 310 to and from a wrapping area. As shown in FIGS. 14–16, the conveyor 330 may include a plurality of rollers 332 mounted between opposite sides 334, 336 that extend between the first and second legs 316, 318. The conveyor 330 moves the load 310 to and from the wrapping area. The load transport surface includes an infeed portion 338 for conveying the load to a wrapping portion, a wrapping portion 340 for supporting the load while it is wrapped, and an outfeed portion 342 for conveying the wrapped load 310 away from the wrapping portion. The load transport surface is substantially the same as that previously described with respect to FIGS. 1–3.

Figure 17A:
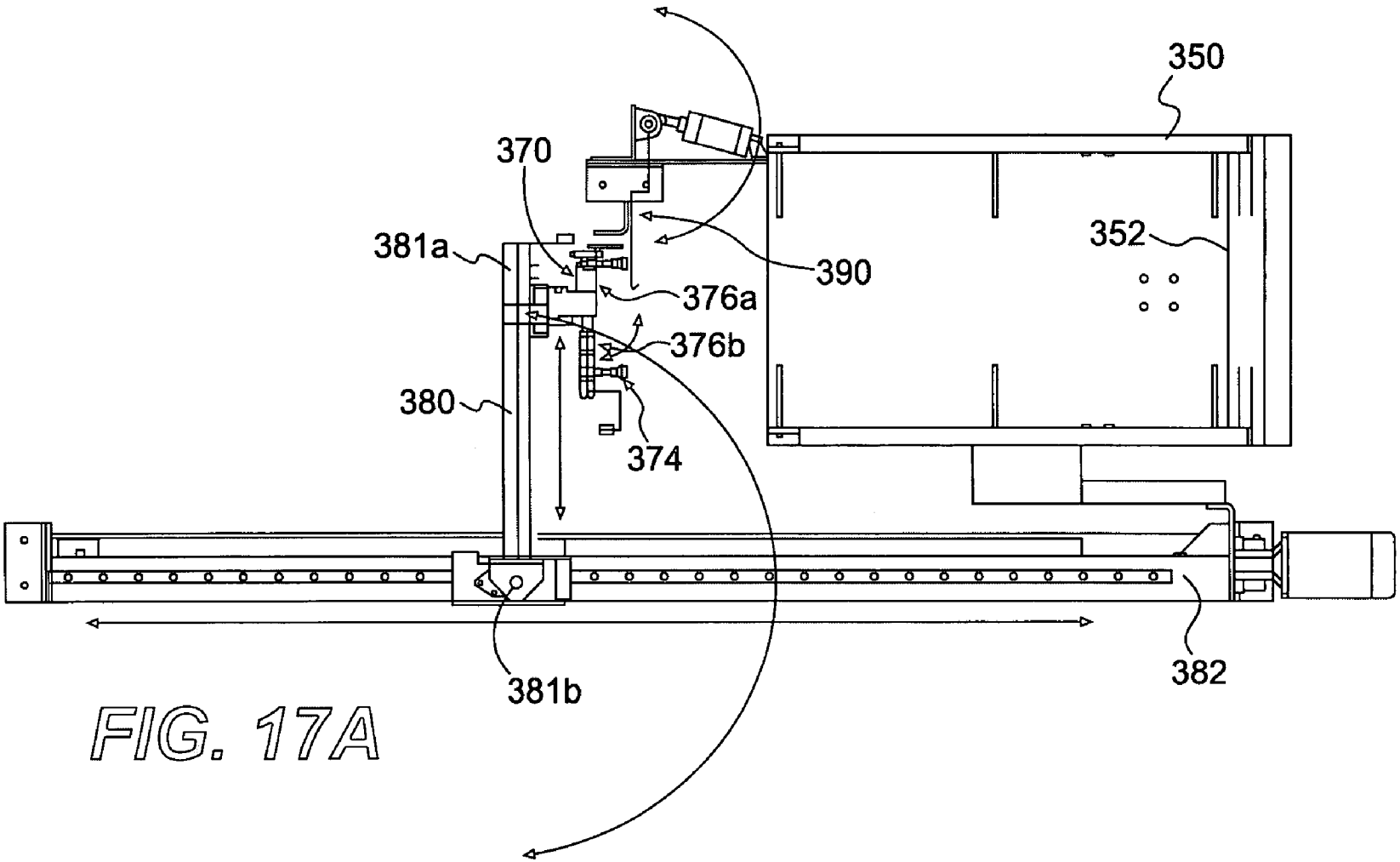
FIG. 17A is a top view of the drive shaft, gripper, clamp, and magazine of the apparatus of FIG. 14 including directional arrows to show direction of movement of the various components.
Figure 17B:
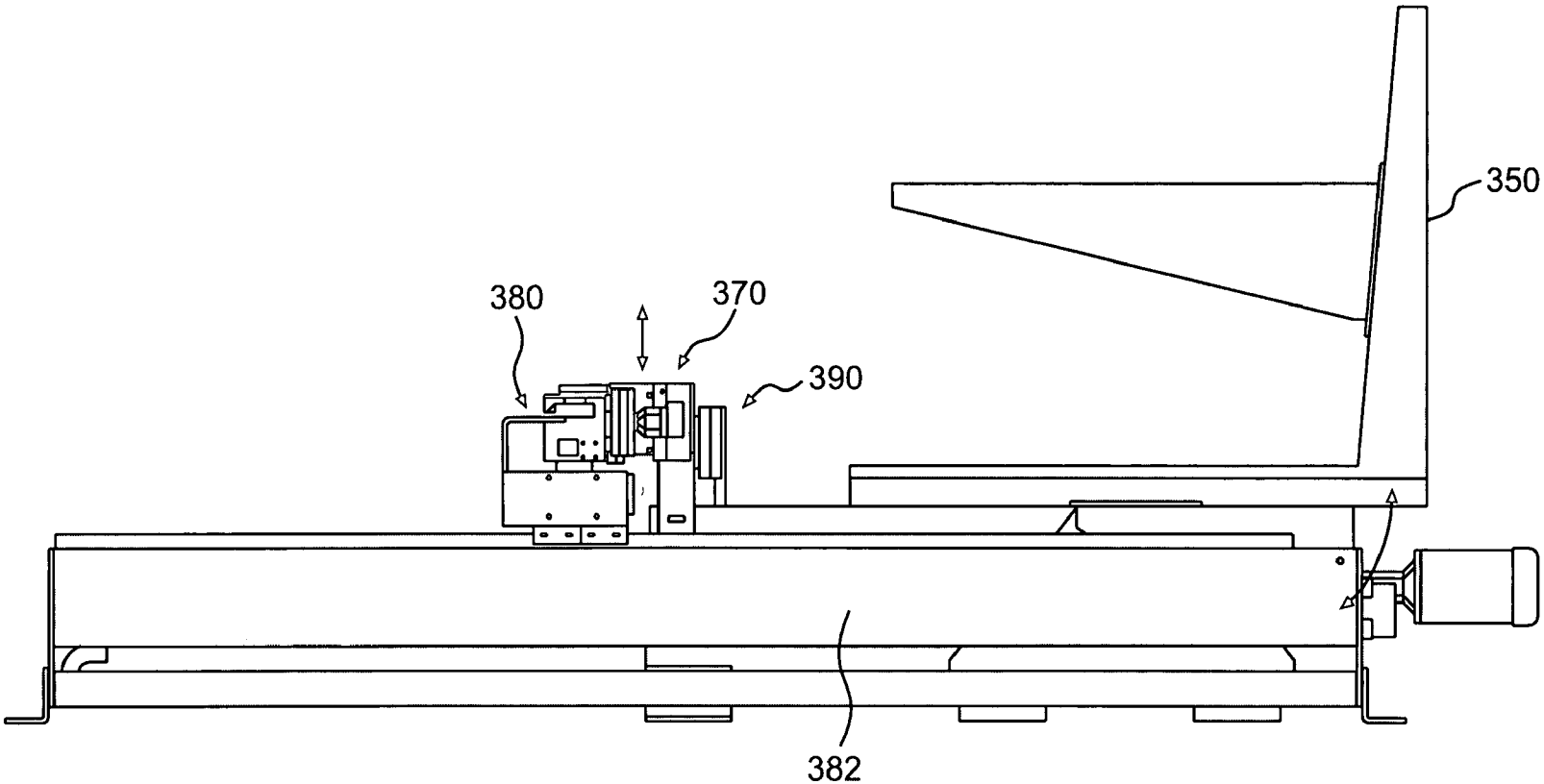
FIG. 17B is a side view of the drive shaft, gripper, clamp, and magazine of FIG. 17A.
Figure 17C:
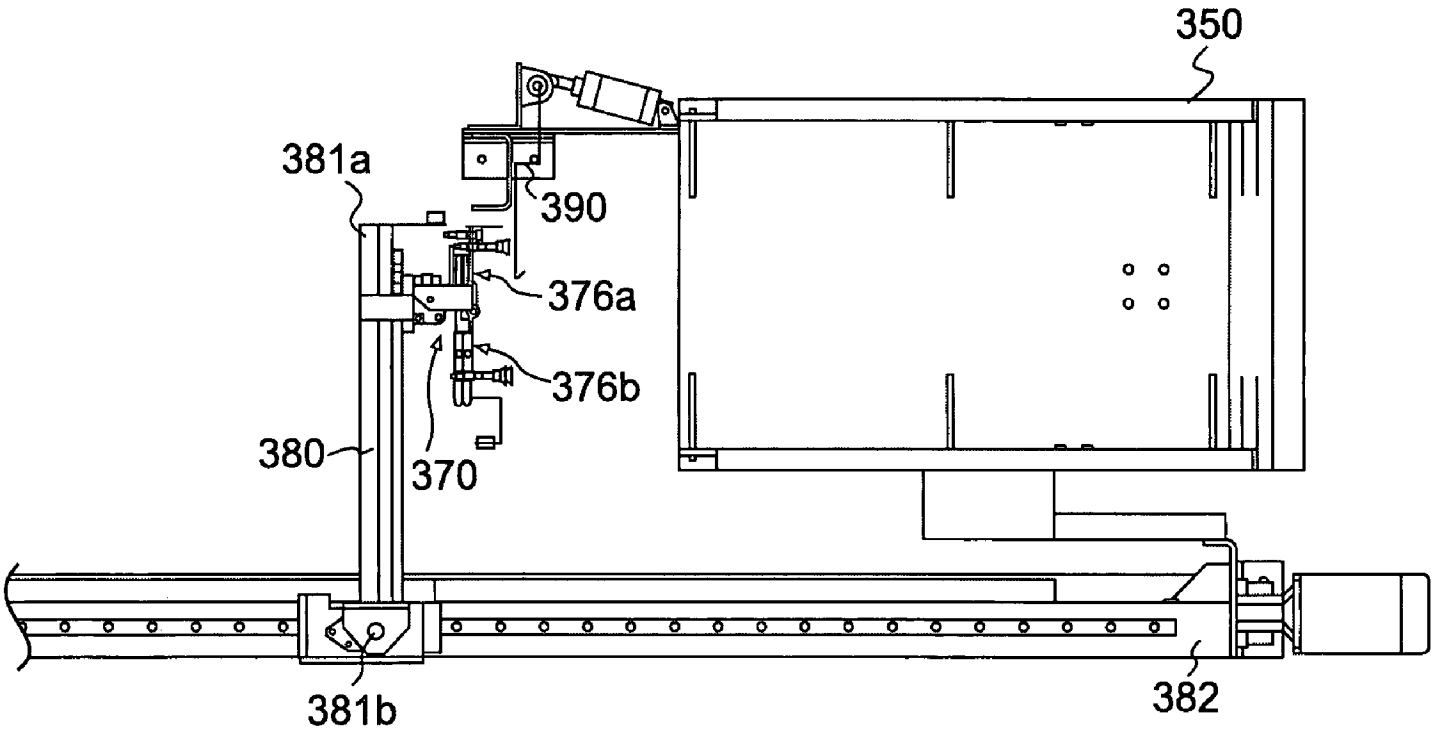
FIG. 17C is an enlarged top view of the gripper, clamp, and magazine of FIG. 17A.
Figure 17D:
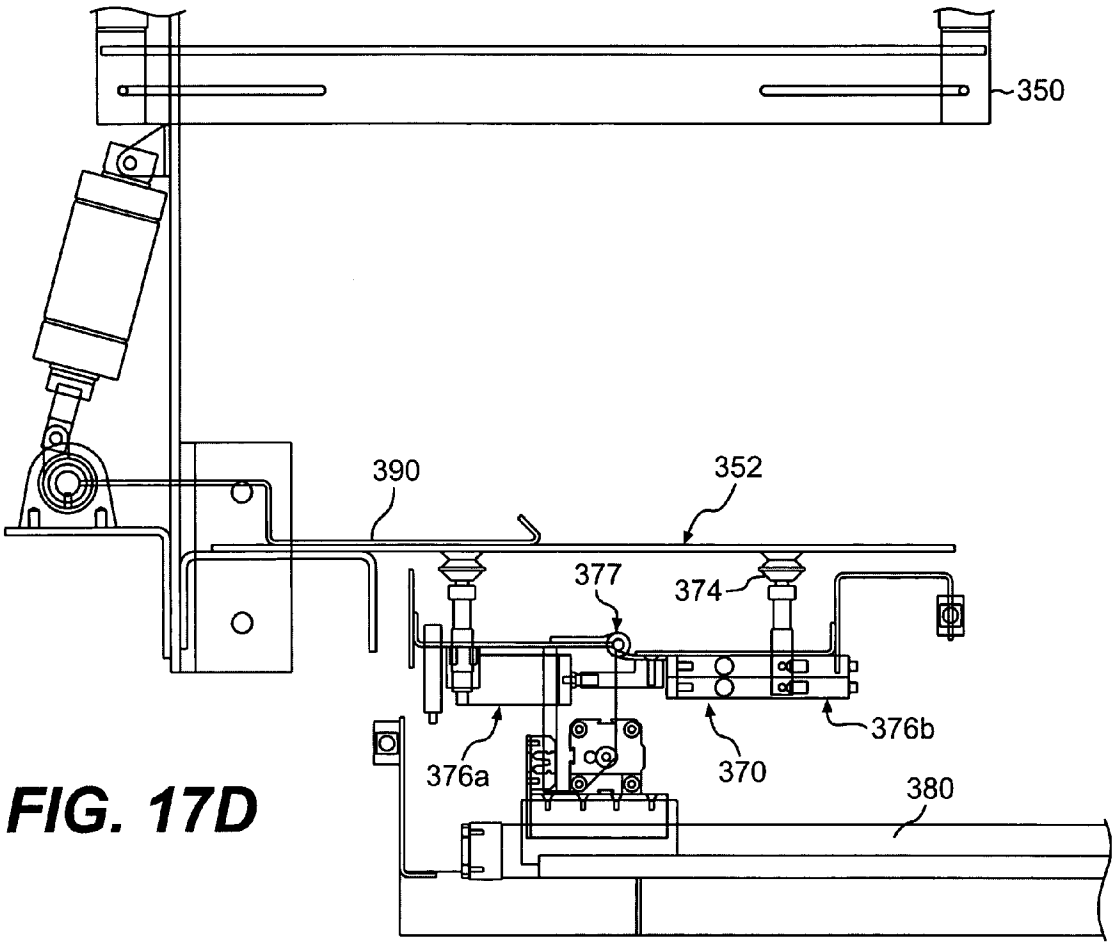
FIG. 17D is an enlarged top view of the gripper and clamp of FIG. 17A.

According to another aspect of the present invention, at least one magazine for containing unformed cornerboards is provided. As shown in FIGS. 17A–17C, a magazine 350 may be configured to hold unformed cornerboards 352. Unformed cornerboards 352 are substantially flat and include a first leg 354 and a second leg 356 connected by a centerline, the first leg 354 forming a angle of 180 degrees with the second leg 356 of the unformed cornerboard 352. Unformed cornerboards 352 are preferably scored or perforated to facilitate bending or folding of the cornerboard to form an angle between the first leg 354 and the second leg 356. Alternatively, the unformed cornerboard 352 may not include anything to facilitate bending. Magazine 350 is passive, i.e., it does not include any indexing means or feeding means for feeding or moving a cornerboard from within the magazine to outside the magazine.

Magazine 350 may include a base 358 and side rails 360*a*, 360*b*. Cornerboards 352 sit on base 358 between side rails 360*a*, 360*b* when stored in magazine 350. Side rails 360*a*, 360*b* may include a brush 362 or other means on an interior surface of rails 360*a*, 360*b* for maintaining cornerboards 352 in an upright position while in magazine 350. Magazine 350 is of sufficient width to contain unformed cornerboards 352. Magazine 350 may be made of steel or any other suitable material. As previously discussed with respect to FIGS. 8–10, magazine 350 is movable between a dispensing position and a loading position, and is moved between the dispensing position and the loading position by a pneumatic cylinder 364. Alternatively, a dual magazine 350*a* may be provided as previously discussed with respect to FIGS. 11A and 11B. Use of a dual magazine is not preferred, however, due to the extra width necessary for each magazine to hold the unformed cornerboards 350. The additional width of the magazines would require more floor space for the wrapping apparatus.

According to one aspect of the present invention, a cornerboard gripper is provided. As embodied herein and shown in FIGS. 17A–17D, a cornerboard gripper 370 includes a body 372 and gripping elements for holding the unformed cornerboard 352. Preferably, the gripping elements include suction cups 374. Cornerboard gripper body 372 preferably includes a first wall portion 376*a* and a second wall portion 376*b*. Preferably, first and second wall portions 376*a*, 376*b* form a 180 degree angle with respect to one another, and are capable of moving from this flat or "open" position to a folded or "closed" position in which the first and second wall portions 376*a*, 376*b* form a right angle or are perpendicular to one another, such that suction cups 374 extending through each wall portion are also at right angles to each other. The open or flat position of cornerboard gripper 370 provides a preferred configuration for gripping and holding unformed cornerboards 152, wherein the first and second sides of the cornerboard form an angle of approximately 180 degrees. Preferably, the first and second wall portions 376*a*, 376*b* of the gripper 370 are connected by a hinge portion 377. The first and second wall portions 376*a*, 376*b* are movable with respect to one another about hinge portion 377. The folded or closed position of the gripper 370 provides a preferred position for gripping and holding the unformed cornerboard 352 after it has been folded or bent. The movement of the first and second wall portions 376*a*, 376*b* with respect to one another about hinge portion 377 can be used to fold or bend the unformed cornerboard 352. The movement of the first and second wall portions 376*a*, 376*b* with respect to one another about hinge portion 377 is provided by an air cylinder.

The cornerboard gripper body 372 may be made from steel or other suitable materials. As previously discussed with respect to FIGS. 4–7, cornerboard gripper 370 also may include proximity sensors for sensing proximity to the load and to the cornerboard when in the magazine.

As shown in FIGS. 14, 15, and 17A–17D, cornerboard gripper 370 is movably mounted on a transfer arm 380. Cornerboard gripper 370 is movable vertically with respect to transfer arm 380. Cornerboard gripper 370 is connected to linear bearing and driven by a rodless air cylinder (additional to that used to move the first and second wall portions 376*a*, 376*b* with respect to one another) to rise vertically approximately six to eight inches (6–8 in.) above the transfer arm. This allows the cornerboard gripper 370 to lift the unformed cornerboard 352 from the base 358 of the magazine 350 prior to moving the cornerboard 352 out of the magazine, as will be described in further detail below. The cornerboard gripper 370 is also driven horizontally by the rodless air cylinder along the length of transfer arm 380, from a free end of the transfer arm 380 to the end of transfer arm 380 mounted to a driving shaft. Cornerboard gripper 370 is moveable in either direction along the length of transfer arm 380.

Transfer arm 380 is mounted on a drive shaft which runs parallel to the load transfer surface 330. Cornerboard gripper 370 is mounted on a free end 381*a* of transfer arm 380. As shown in FIGS. 14–17D, the other end 381*b* of transfer arm 380 is mounted on polished shaft 382 which is preferably positioned between the load transfer surface 330 and magazine 350. Transfer arm 380 is positioned such that it can move cornerboard gripper 370 into magazine 350, above base 358 and below side rails 360*a*, 360*b*, until it comes into contact with an unformed cornerboard 352. Transfer arm 380 is also positioned such that it can move cornerboard gripper 370 to a position adjacent a front surface of the load 310. In order to move cornerboard gripper 370 between magazine 350 and load 310, transfer arm is mounted on polished shaft 382 which is motor driven. The transfer arm 380 is mounted on a linear bearing and connected with a biased cam follower nut which drives the transfer arm 380 forward with rotation of the shaft 382 in a first direction. Rotation of shaft 382 in an opposite direction drives transfer arm 380 in a reverse direction. Thus, movement of transfer arm 380 on shaft 382 is much like a nut on a threaded shaft. However, because no threads are used, if the transfer arm encounters interference as it moves on shaft 382, transfer arm 380 will slip on shaft 382 instead of continuing to move forward or binding up. This adds an extra measure of safety to the apparatus design. Other alternatives for driving the transfer arm 380 may include a threaded shaft or a chain and sprocket type arrangement or any other type of suitable arrangement to move the transfer arm 180 in both directions along the length of the load transport surface 330.

Transfer arm 380 is also mounted to be rotatable between a cornerboard pickup position and a cornerboard placement position. Preferably, rotation of transfer arm 380 is controlled by a rotary air cylinder with precise limits of rotation. Alternatively, rotation of the transfer arm 380 may be controlled by hydraulics, electric motor, or other suitable means The limits of rotation of transfer arm 380 are set for an unformed cornerboard 352. For an unformed cornerboard 352, the transfer arm 380 rotates 180 degrees. Rotation of the transfer arm 380 by 180 degrees serves to align the cornerboard gripper 370 and cornerboard 352 such that the transfer arm 380, the first wall portion 376*a* of the cornerboard gripper 370, and the first leg 354 of cornerboard 352 are perpendicular to a longitudinal axis 331 of the load transport surface and parallel to a front surface of the load 310. The second wall portion 376*b* of the cornerboard gripper 370 and second leg portion 356 of cornerboard 352 are parallel to the longitudinal axis 331 of the load transport surface and parallel to a side surface of the load 310.

The transfer arm 380 is movable on shaft 382 in a direction parallel to the longitudinal axis 331 of the load transport surface 330 and in a direction parallel to a direction of movement of the load on the load transport surface. The cornerboard gripper 370 is movable along transfer arm 380 in a direction perpendicular to the longitudinal axis of the load transport surface and in a direction perpendicular to the direction of movement of the load on the load transport surface.

According to another aspect of the invention, a clamp for facilitating folding of the unformed cornerboard is provided. As embodied herein and shown in FIGS. 17A–17D, a clamp 390 is provided adjacent to magazine 350. Preferably, clamp 390 is connected to the base that magazine 350 sits upon. Clamp 390 may be connected to any other suitable location that positions the clamp near transport arm 380 and gripper 370. Clamp 390 includes a first mounted/fixed end 392*a* and a second free end 392*b*. As indicated by arrow 394 in FIG. 17A, clamp 390 is movable, preferably rotatable, between a retracted position out of the path of gripper 370 and transport arm 380 and an extended position in the path of gripper 370 and transport arm 380. Clamp 390 is preferably actuated by an air cylinder 396, although other suitable means may be used to actuate clamp 390. Clamp 390 should be of sufficient length that when in the extended position, the free end 392*b* is approximately aligned with hinge 377 of cornerboard gripper 370. This positions the free end 392*b* of the clamp 390 approximately where any scoring or perforations of the unformed cornerboard would be located. When a cornerboard is held between clamp 390 and gripper 370, placement of the free end 392*b* of the clamp 390 near the scoring or perforations encourages folding of the unformed cornerboard at the scoring or perforations. Clamp 390 may be made of steel or other suitable materials and preferably has a flat, thin shape. It is possible that the clamp 390 be replaced by an alternative structure for providing a surface against which to fold the cornerboard, such as, for example, a mandrel.

Although it is preferred that a clamp be provided to facilitate bending of the unformed cornerboard 352, it is possible that a clamp may not be provided. In such an embodiment, the suction of the suction cups 374 must be sufficient to hold the unformed cornerboard 352 as the cornerboard gripper 370 moves from the open/flat position to the folded/closed position, bending the cornerboard 352. Alternatively, the cornerboard gripper 370 may not be movable between a flat configuration and a folded configuration, and instead may have the folded configuration described with respect to FIGS. 4–7. In such an embodiment, the unformed cornerboard may be folded on the load, as described later below.

According to another aspect of the invention, apparatus 300 may be provided with other wrapping elements. As embodied herein and shown in FIGS. 14–16, various commonly used stretch wrapping elements may be mounted on the load transport surface 330. For example, a packaging material holder may be provided for gripping an end of the stretch wrapping material 314 during initiation and termination of a wrapping cycles. A cutter may also be provided for cutting the stretch wrapping material at the end of a wrapping cycle. The cutter may include a cutting blade or blades, or a heating element, as are commonly used. A wipedown device may be provided for attaching a cut end of stretch wrapping material to the load after being cut by the cutter.

In a preferred embodiment, as embodied herein and shown in FIGS. 14–16, apparatus 300 is provided with four magazines 350*a*, 350*b*, 350*c*, and 350*d*. Two of the magazines 350*a*, 350*b*, are positioned on one side of conveyor 330, parallel to conveyor 330, one on either side of wrapping portion 340 of conveyor 330. In such an embodiment, a drive shaft 382*a*, 382*b*, 382*c*, 382*d* is associated with each magazine, two provided on each side of conveyor 330. Magazines 350*c*, 350*d*, are positioned on the other side of conveyor 330, parallel to conveyor 330, one on either side of wrapping portion 340 of conveyor 330. Four transfer arms, 380, 380*a*, 380*b*, 380*c*, and 380*d* are also provided, each being mounted on a respective drive shaft 382*a*, 382*b*, 382*c*, and 382*d*. Each transfer arm 380*a*, 380*b*, 380*c*, and 380*d* has mounted thereon a cornerboard gripper 370*a*, 370*b*, 370*c*, and 370*d*, respectively.

According to an alternative embodiment of the present invention, a wrapping apparatus 400 includes a packaging material dispenser, at least one magazine for containing unformed cornerboards, means for providing relative rotation between the load and the dispenser, a clamp for facilitating folding of unformed cornerboards, and a cornerboard gripper.

Figure 18:
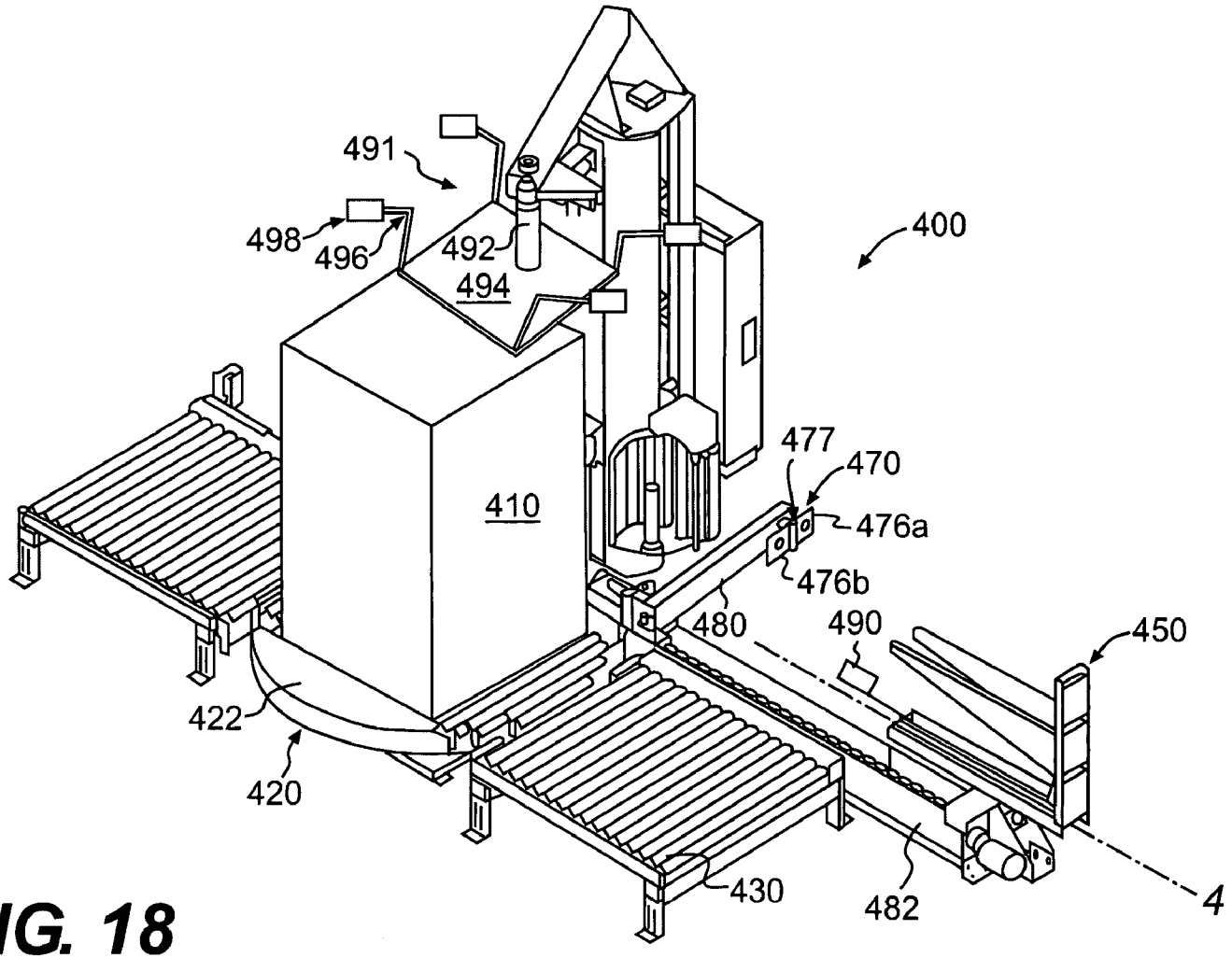
FIG. 18 is an isometric view of another alternative embodiment of an apparatus for placing corner boards on a load and wrapping the load with the corner boards in place.

As embodied herein and shown in FIG. 18, a packaging material dispenser 402 for dispensing packaging material is provided. Packaging material dispenser 402 dispenses a sheet of packaging material 414 in a web form and includes a roll carriage 409 that supports a roll of packaging material 408. Roll carriage 409 of dispenser 402 is mounted on and vertically moveable on a mast 404, shown in FIG. 18, to dispense packaging material 414 spirally about load 410 as rotation is provided between load 410 and dispenser 402. In a preferred embodiment, stretch wrap packaging material is used, although various other packaging materials, generally not considered to be stretch wrap materials, such as netting, strapping, banding, and tape, can be used as well.

According to another aspect of the invention, apparatus 400 includes means for providing relative rotation between the dispenser and the load to wrap packaging material around the load. As embodied herein and shown in FIG. 18, the means for providing relative rotation include a conventional turntable assembly 420 having a rotatable turntable 422. Turntable assembly 420 is substantially identical to turntable assembly 220 previously discussed with respect to FIGS. 12 and 13.

According to another aspect of the present invention, at least one magazine for containing cornerboards is provided. As shown in FIG. 18, a magazine 450 is provided. Magazine 450 is configured to hold unformed cornerboards 252. Magazine 450 is substantially identical to magazine 350 previously discussed with respect to FIGS. 17A–17C. Alternatively, a dual magazine may be used as previously discussed with respect to FIGS. 11A and 11B.

According to one aspect of the present invention, a cornerboard gripper is provided. As embodied herein and shown in FIG. 18, a cornerboard gripper 470 is substantially identical to the cornerboard gripper 370 discussed with respect to FIGS. 17A–17D.

As shown in FIG. 18, cornerboard gripper 470 is movably mounted on a transfer arm 480. Cornerboard gripper 470 is movable vertically with respect to transfer arm 480. Cornerboard gripper 470 is connected to linear bearing and driven by a rodless air cylinder to rise vertically approximately six to eight inches (6-8 in.) above the transfer arm. This allows the cornerboard gripper 470 to lift the unformed cornerboard 452 from the base 458 of the magazine 450 prior to moving the unformed cornerboard 452 out of the magazine, as will be described in further detail below. The first and second wall portions of the cornerboard gripper 470 are actuated to move between the open, flat position and the folded, closed position by the rodless air cylinder. The cornerboard gripper 470 is also driven horizontally by the rodless air cylinder along the length of transfer arm 480, from a free end 481*a* of the transfer arm 480 to the end of transfer arm 480 mounted to a driving shaft 482. Cornerboard gripper 470 is moveable in either direction along the length of transfer arm 480.

Transfer arm 480 is mounted on a drive shaft which is adjacent to turntable 420 and runs parallel to longitudinal axis 451 of magazine 450. Cornerboard gripper 470 is mounted on a free end 481*a* of transfer arm 480. The other end 481*b* of transfer arm 480 is mounted on polished shaft 482 which is preferably positioned between the turntable 420 and magazine 450. Transfer arm 480 is positioned such that it can move cornerboard gripper 470 into magazine 450, above base 458 and below side rails 460*a*, 460*b*, until it comes into contact with an unformed cornerboard 452. Transfer arm 480 is also positioned such that it can move cornerboard gripper 470 to a position adjacent a front surface of the load 410. In order to move cornerboard gripper 470 between magazine 450 and load 410, transfer arm 480 is mounted on polished shaft 482 which is motor driven. The transfer arm 480 is mounted, driven, and moveable in substantially the same manner as discussed with respect to transfer arm 380 of FIGS. 14–16. However, instead of moving in a direction parallel to a load transport surface, transfer arm 480 moves in a direction parallel with the longitudinal axis 451 of magazine 450.

Transfer arm 480 is also mounted to be rotatable by 180 degrees between a cornerboard pickup position and a cornerboard placement position. Rotation of the transfer arm 480 serves to align the cornerboard gripper 470 and cornerboard 452 with a corner of the load 410. After rotation, the transfer arm 480 and the first leg 454 of cornerboard 452 are perpendicular to the longitudinal axis 451 of magazine 450 and parallel to a front surface of the load 410. The second leg portion 456 of cornerboard 452 is parallel to the longitudinal axis 451 of the magazine 450 and parallel to a side surface of the load 410.

According to another aspect of the invention, a clamp for facilitating folding of the unformed cornerboard is provided. As embodied herein and shown in FIG. 18, a clamp 490 is provided adjacent to magazine 450. Clamp 490 is substantially identical to clamp 390 previously discussed with respect to FIGS. 17A–17D.

According to another aspect of the invention, a cornerboard holding device may be provided. Because the turntable rotates to provide relative rotation between the load 410 and the packaging material dispenser 402, the cornerboard gripper 470 cannot hold the cornerboard 452 onto the load while it is secured to the load by the packaging material. Thus, as embodied herein and shown in FIG. 18, a cornerboard holding device includes a top platen 490. Top platen 490 is substantially identical to top platen 290 previously discussed with respect to FIGS. 12 and 13.

A method of placing cornerboards on a load and wrapping the load and the cornerboards (FIGS. 1–3) will now be described.

In use, magazine 150 of apparatus 100 (FIGS. 1–3) is filled with pre-formed cornerboards 152, preferably prior to wrapping. The magazine 150 is tilted from the dispensing position to the loading position to receive the cornerboards 152. After the magazine is full, the magazine is returned to the dispensing position.

A load 110 moves on conveyor 130, from an infeed portion 138 to a load wrapping portion 140. Once the load 110 reaches the load wrapping portion 140, the conveyor 130 stops moving, leaving load 110 stationary. Transfer arm 180 moves along shaft 182, parallel to conveyor 130 and toward magazine 150. Cornerboard gripper 170 is positioned in on the free end 181*a* of transfer arm 180. Transfer arm 180 moves cornerboard gripper 170 until suction cups 174 are proximate cornerboard 152 as sensed by sensor 178*c*. Suction is actuated and suction cups 174 adhere to legs 154, 156 of cornerboard 152. Cornerboard gripper 170 moves linearly and vertically with respect to transfer arm 180, raising cornerboard 152 approximately 6–8 inches above the base 158 of magazine 150. Transfer arm 180 then moves with cornerboard gripper 170, which is holding cornerboard 152, along shaft 182, parallel to conveyor 130 and toward load 110 until cornerboard gripper 170 and cornerboard 152 is clear of magazine 150. Once clear of magazine 150, cornerboard gripper 170 with cornerboard 152 moves linearly and horizontally along transfer arm 180 to the mounted end 181*b* of transfer arm 180. After cornerboard gripper 170 and cornerboard 152 reach end 181*b* of transfer arm 180, transfer arm 180 rotates 135 degrees, positioning cornerboard 152 such that the first leg 154 of cornerboard 152 is perpendicular to the conveyor 130 and the second leg 156 of cornerboard 152 is parallel to the conveyor 130.

After rotation, transfer arm 180 moves with cornerboard gripper 170, which is holding cornerboard 152, along shaft 182, parallel to conveyor 130 and toward load 110 until sensor 178*a* senses that the first leg 154 of the cornerboard 152 is proximate a front face (side of load facing magazine 150 and perpendicular to conveyor 130) of the load 110. Once sensor 178*a* senses proximity to the front face of load 110, transfer arm 180 stops moving. Cornerboard gripper 170 then begins to move linearly and horizontally along transfer arm 180 toward free end 181*a* until sensor 178*b* senses that the second leg 156 of cornerboard 152 is proximate a side face (side of load parallel to conveyor 130 and adjacent to drive shaft 182) of load 110. Once sensor 178*b* senses proximity to the side face of the load 110, cornerboard gripper 170 stops moving along transfer arm 180. At this point, the first leg 154 of cornerboard 152 is proximate the front surface of the load 110 and the second leg 156 is proximate the side face of the load 110. Cornerboard gripper 170 holds the cornerboard 152 in this position as dispenser 102 begins to rotate around load 110, dispensing packaging material 114. As packaging material 114 is wrapped around the load 110, cornerboard 152 is secured to the corner of the load 110.

Alternatively, if wrapping portion 140 includes a turntable, dispenser 102 may remain stationary while the turntable rotates the load to provide relative movement between the dispenser and the load and to wrap packaging material around the load. In such an embodiment, a top platen is preferably provided to hold the cornerboards in place as the load rotates as discussed previously with respect to FIG. 12, instead of having the cornerboard gripper hold the cornerboard during initial wrapping. Additionally, all four cornerboards would preferably be placed before any wrapping occurs.

Once the cornerboard 152 is secured to the corner of the load, suction cups 174 of cornerboard gripper 170 release cornerboard 152 as dispenser 102 continues to rotate about load 110 to wrap packaging material around the sides of load 110. Cornerboard gripper 170 then moves linearly and horizontally along transfer arm 180 toward mounted end 181*b*. Transfer arm 180 then rotates 135 degrees. After rotation, transfer arm 180 moves along shaft 182 toward magazine 150 and cornerboard gripper 170 then moves to the free end 181*a* of transfer arm 180. The cycle can then begin again.

In the preferred embodiment, where four magazines 150*a*, 150*b*, 150*c*, and 150*d*, four shafts 182*a*, 182*b*, 182*c*, and 182*d*, four transfer arms 180*a*, 180*b*, 180*c*, and 180*d*, and four cornerboard grippers 170*a*, 170*b*, 170*c*, and 170*d*, are provided, each transfer arm 180*a*, 180*b*, 180*c*, and 180*d*, and cornerboard gripper 170*a*, 170*b*, 170*c*, and 170*d*, are approximately simultaneously performing the above described procedure. Thus, four cornerboards 152 are placed on four corners of the load 110 at approximately the same time. Of course, if the magazines 150*a*, 150*b*, 150*c*, and 150*d*, are not all filled to the same level, movement of a cornerboard 152 from one magazine to the load 110 may take more or less time than movement of a cornerboard 152 from another magazine. Once all four cornerboards 152 are in place, dispenser 102 begins to rotate around load 110 to wrap packaging material 114 around load 110. Once the cornerboards 152 are secured to the load 110 by the packaging material 114, the cornerboard grippers 170*a*, 170*b*, 170*c*, and 170*d*, release the cornerboards 152 and are moved away from the load 110 as described above. Alternatively, if wrapping area 140 is provided with a turntable, as each cornerboard is placed, an arm of a top platen on top of the load 110 is actuated to bring a hand into engagement with the cornerboard, holding the cornerboard in place. Once each cornerboard is secured by a hand, the turntable begins to rotate, and packaging material is wrapped around the load, securing the cornerboards to the load.

A method of placing cornerboards on a load and wrapping the load and the cornerboards (FIGS. 12 and 13) will now be described.

In use, magazine 250 of apparatus 200 (FIGS. 12 and 13) is filled with pre-formed cornerboards 252, preferably prior to wrapping. The magazine 250 is tilted from the dispensing position to the loading position to receive the cornerboards 252. After the magazine is full, the magazine is returned to the dispensing position.

A load 210 is placed on turntable 220 in preparation for wrapping. Transfer arm 280 moves along shaft 282, parallel to the longitudinal axis 251 of magazine 250 and toward magazine 250. Cornerboard gripper 270 is positioned in on the free end 281*a* of transfer arm 280. Transfer arm 280 moves cornerboard gripper 270 until suction cups 274 are proximate cornerboard 252 as sensed by sensor 278*c*. Suction is actuated and suction cups 274 adhere to legs 254, 256 of cornerboard 252. Cornerboard gripper 270 moves linearly and vertically with respect to transfer arm 280, raising cornerboard 252 approximately 4 inches to give a height of 6–8 inches above a conveying surface 230. The height the cornerboard is lifted and the spacing between the cornerboard and a support surface may be adjusted as necessary.

Transfer arm 280 then moves with cornerboard gripper 270, which is holding cornerboard 252, along shaft 282, parallel to the longitudinal axis 251 of magazine 250 and toward load 210 until cornerboard gripper 270 and cornerboard 252 is clear of magazine 250. Once clear of magazine 250, cornerboard gripper 270 with cornerboard 252 moves linearly and horizontally along transfer arm 280 to the mounted end 281*b* of transfer arm 280. After cornerboard gripper 270 and cornerboard 252 reach end 281*b* of transfer arm 280, transfer arm 280 rotates 135 degrees, positioning cornerboard 252 such that the first leg 254 of cornerboard 152 is perpendicular to the longitudinal axis 251 of the magazine 250 and the second leg 256 of cornerboard 252 is parallel to the longitudinal axis 251 of magazine 250.

After rotation, transfer arm 280 moves with cornerboard gripper 270, which is holding cornerboard 252, along shaft 282, parallel to longitudinal axis 251 of magazine 250 and toward load 210 until sensor 278*a* senses that the first leg 254 of the cornerboard 252 is proximate a front face (side of load facing magazine 250 and perpendicular to longitudinal axis 251 of magazine 250) of the load 210. Once sensor 278*a* senses proximity to the front face of load 210, transfer arm 280 stops moving. Cornerboard gripper 270 then begins to move linearly and horizontally along transfer arm 280 toward free end 281*a* until sensor 278*b* senses that the second leg 256 of cornerboard 252 is proximate a side face (side of load parallel to longitudinal axis 251 of magazine 250 and adjacent to drive shaft 282) of load 210. Once sensor 278*b* senses proximity to the side face of the load 210, cornerboard gripper 270 stops moving along transfer arm 280. At this point, the first leg 254 of cornerboard 252 is proximate the front surface of the load 210 and the second leg 256 is proximate the side face of the load 210. A top platen 290 may already be resting on top of load 210 or may now come to rest on top of load 210. An arm 296 of top platen 290 is actuated to move from a non-engaging position to an engaging position, bringing a hand 298 into contact with cornerboard 252, holding cornerboard 252 in place against load 210.

Once the cornerboard 252 is secured to the corner of the load by hand 298, suction cups 274 of cornerboard gripper 270 release cornerboard 252. Turntable 220 rotates a quarter of a revolution, such that the load 210 is rotated 90 degrees from its original position, and is ready to receive another cornerboard. Cornerboard gripper 270 then moves linearly and horizontally along transfer arm 280 toward mounted end 281*b*. Transfer arm 280 then rotates 135 degrees. After rotation, transfer arm 280 moves along shaft 282 toward magazine 250 and cornerboard gripper 270 then moves to the free end 281*a* of transfer arm 280. Cornerboard gripper 270 moves into magazine 250 and secures a second cornerboard 252*a*. The process described above is repeated until cornerboard 252*a* is secured to the load by another hand 298. This process is repeated two more times, as third and forth cornerboards 252*b*, 252*c*, are placed on the load 210. Once four cornerboards have been secured to the load, turntable 220 rotates to provide relative rotation between load 210 and packaging material dispenser 202 to wrap packaging material 214 around the load. The turntable continues to rotate until load 210 is completely wrapped in packaging material 214, and top platen 290 rotates with the load 210 about shaft 292.

A method of placing cornerboards on a load and wrapping the load and the cornerboards (FIGS. 14–16) will now be described.

In use, magazine 350 of apparatus 300 (FIGS. 14–16, and 17A) is filled with unformed cornerboards 352, preferably prior to wrapping. The magazine 350 is tilted from the dispensing position to the loading position to receive the cornerboards 352. After the magazine is full, the magazine is returned to the dispensing position.

A load 310 moves on conveyor 330, from an infeed portion 338 to a load wrapping portion 340. Once the load 310 reaches the load wrapping portion 340, the conveyor 330 stops moving, leaving load 310 stationary. Transfer arm 380 moves along shaft 382, parallel to conveyor 330 and toward magazine 350. Cornerboard gripper 370 is positioned in on the free end 381*a* of transfer arm 380. Transfer arm 380 moves cornerboard gripper 370 until suction cups 374 are proximate unformed cornerboard 352 as sensed by a proximity sensor. Suction is actuated and suction cups 374 adhere to legs 354, 356 of unformed cornerboard 352. Cornerboard gripper 370 moves linearly and vertically with respect to transfer arm 380, raising cornerboard 352 approximately 6–8 inches above the base 358 of magazine 350. Transfer arm 380 then moves with cornerboard gripper 370, which is holding cornerboard 352, along shaft 382, parallel to conveyor 330 and toward load 310 until cornerboard gripper 370 and cornerboard 352 are clear of magazine 350. Once gripper 370 and cornerboard 352 are clear of magazine 350, clamp 390 is actuated to move from the retracted position to the extended position, for example by rotation of 180 degrees about a pivot point or hinge. In the extended position, clamp 390 comes into contact with the cornerboard 352 such that cornerboard 352 is between clamp 390 and gripper 370, at least a portion of the unformed cornerboard being held between the clamp 390 and wall portion 376*a* and suction cup 374. Preferably, the free end of clamp 390 is positioned at the center of the unformed cornerboard 352, which may include scoring or perforations. Then, wall portion 376*b* moves about hinge 377 toward wall portion 376*a* while the suction cup 374 on wall portion 376*b* maintains suction on the unformed cornerboard 352, causing the unformed cornerboard 352 to fold (preferably along a scored line or plurality of perforations) as the wall portions 376*a*, 376*b* move from the open position to the closed position.

After the cornerboard 352 is folded, cornerboard gripper 370 and now folded cornerboard 352 move linearly and horizontally along transfer arm 380 to the mounted end 381*b* of transfer arm 380. After cornerboard gripper 370 and folded cornerboard 352 reach end 381*b* of transfer arm 380, transfer arm 380 rotates 180 degrees, positioning folded cornerboard 352 such that the first leg 354 of cornerboard 352 is perpendicular to the conveyor 330 and the second leg 356 of cornerboard 352 is parallel to the conveyor 330.

After rotation, transfer arm 380 moves with cornerboard gripper 370, which is holding cornerboard 352, along shaft 1382, parallel to conveyor 330 and toward load 310 until a sensor senses that the first leg 354 of the cornerboard 352 is proximate a front face (side of load facing magazine 350 and perpendicular to conveyor 330) of the load 310. Once the sensor senses proximity to the front face of load 310, transfer arm 380 stops moving. Cornerboard gripper 370 then begins to move linearly and horizontally along transfer arm 380 toward free end 381*a* until another sensor senses that the second leg 356 of cornerboard 352 is proximate a side face (side of load parallel to conveyor 330 and adjacent to drive shaft 382) of load 310. Once the sensor senses proximity to the side face of the load 310, cornerboard gripper 370 stops moving along transfer arm 380. At this point, the first leg 354 of cornerboard 352 is proximate the front surface of the load 310 and the second leg 356 is proximate the side face of the load 310. Cornerboard gripper

370 holds the cornerboard 352 in this position as dispenser 302 begins to rotate around load 310, dispensing packaging material 314. As packaging material 314 is wrapped around the load 310, cornerboard 352 is secured to the corner of the load 110.

Alternatively, if wrapping portion 340 includes a turntable, dispenser 302 may remain stationary while the turntable rotates the load to provide relative movement between the dispenser and the load and to wrap packaging material around the load. In such an embodiment, a top platen is preferably provided to hold the cornerboards in place as the load rotates as discussed previously with respect to FIG. 12, instead of having the cornerboard gripper hold the cornerboard during initial wrapping. Additionally, all four cornerboards would preferably be placed before any wrapping occurs.

Once the cornerboard 352 is secured to the corner of the load, suction cups 374 of cornerboard gripper 370 release cornerboard 352 as dispenser 302 continues to rotate about load 310 to wrap packaging material around the sides of load 310. Cornerboard gripper 370 then moves linearly and horizontally along transfer arm 380 toward mounted end 381*b*. Transfer arm 380 then rotates 180 degrees and cornerboard gripper 370 "unfolds" to return to the open or flat position. After rotation, transfer arm 380 moves along shaft 382 toward magazine 350 and cornerboard gripper 370 then moves to the free end 381*a* of transfer arm 380. The cycle can then begin again. In the preferred embodiment, where four magazines 350*a*, 350*b*, 350*c*, and 350*d*, four shafts 382*a*, 382*b*, 382*c*, and 382*d*, four transfer arms 380*a*, 380*b*, 380*c*, and 380*d*, and four cornerboard grippers 370*a*, 370*b*, 370*c*, and 370*d*, are provided, each transfer arm 380*a*, 380*b*, 380*c*, and 380*d*, and cornerboard gripper 370*a*, 370*b*, 370*c*, and 370*d*, are approximately simultaneously performing the above described procedure. Thus, four cornerboards 352 are placed on four corners of the load 310 at approximately the same time. Of course, if the magazines 350*a*, 350*b*, 350*c*, and 350*d*, are not filled to the same level, movement of a cornerboard 352 from one magazine to the load 310 may take more or less time than movement of a cornerboard 352 from another magazine. Once all four cornerboards 352 are in place, dispenser 302 begins to rotate around load 310 to wrap packaging material 314 around load 310. Once the cornerboards 352 are secured to the load 310 by the packaging material 314, the cornerboard grippers 370*a*, 370*b*, 370*c*, and 370*d*, release the cornerboards 352 and are moved away from the load 310 as described above. Alternatively, if wrapping area 340 is provided with a turntable, as each cornerboard is placed, an arm of a top platen on top of the load 310 is actuated to bring a hand into engagement with the cornerboard, holding the cornerboard in place. Once each cornerboard is secured by a hand, the turntable begins to rotate, and packaging material is wrapped around the load, securing the cornerboards to the load.

Alternatively, the apparatus 300 may not be provided with a clamp 390 to facilitate folding/bending of unformed cornerboards 352. In such an embodiment, the method of use would be substantially the same, except that the bending/folding of the cornerboard 352 would be caused solely by moving the cornerboard gripper 370 from the open/flat position to the folded/closed position. It would be necessary to ensure that the suction cups 374 apply sufficient suction to the cornerboard to prevent it from slipping during folding. In addition, it would be preferable that the hinge 377 of the cornerboard gripper 370 be aligned with any scoring or perforations in the unformed cornerboard, and that the scoring/perforations be sufficient to assist in folding the unformed cornerboard.

In another alternative, a clamp 390 may not be provided and gripper 370 may not move between a flat position and a folded position. Each unformed cornerboard 352 could be transported to a side of the load as previously described with respect to FIGS. 1–3. However, the cornerboard would have to be pressed against the side of the load upstream of and parallel to the film path. In this manner, as the packaging material is wrapped around the load, it would secure one leg of the cornerboard 352 to the load. Then, as the packaging material moved around the corner of the load, it would engage the portion of the cornerboard 352 (other leg) in its film path and pull the other leg into contact with the other side of the corner of the load, forming the cornerboard 352 and securing it to the load at the same time.

A method of placing cornerboards on a load and wrapping the load and the cornerboards (FIG. 18) will now be described.

In use, magazine 450 of apparatus 400 (FIG. 18) is filled with unformed cornerboards 452, preferably prior to wrapping. The magazine 450 is tilted from the dispensing position to the loading position to receive the cornerboards 452. After the magazine is full, the magazine is returned to the dispensing position.

A load 410 is placed on turntable 420 in preparation for wrapping. Transfer arm 480 moves along shaft 482, parallel to the longitudinal axis 451 of magazine 450 and toward magazine 450. Cornerboard gripper 470 is positioned in on the free end 481*a* of transfer arm 480 in its open or flat position, such that the first and second wall portions of the gripper 470 form an angle of approximately 180 degrees with one another. Transfer arm 480 moves cornerboard gripper 470 until suction cups 474 are proximate cornerboard 452 as sensed by a sensor. Suction is actuated and suction cups 474 adhere to legs 454, 456 of cornerboard 452. Cornerboard gripper 470 moves linearly and vertically with respect to transfer arm 480, raising cornerboard 452 approximately 6–8 inches above the base 458 of magazine 450. Transfer arm 480 then moves with cornerboard gripper 470, which is holding cornerboard 452, along shaft 482, parallel to the longitudinal axis 451 of magazine 450 and toward load 410 until cornerboard gripper 470 and cornerboard 452 is clear of magazine 450. Once the gripper 470 and cornerboard 452 are clear of magazine 450, clamp 490 is actuated to move from the retracted position to the extended position, for example by rotation of 180 degrees about a pivot point or hinge. In the extended position, clamp 490 comes into contact with the cornerboard 452 such that cornerboard 452 is between clamp 490 and gripper 470, at least a portion of the unformed cornerboard 452 being held between the clamp 490 and first wall portion of the gripper and suction cup. Preferably, the free end of clamp 490 is positioned at the center of the unformed cornerboard 452, which may include scoring or perforations. Then, the second wall portion moves about a hinge toward the first wall portion while the suction cup on the second wall portion maintains suction on the unformed cornerboard 452, causing the unformed cornerboard 452 to fold (preferably along a scored line or plurality of perforations) as the first and second wall portions move from the open position to the closed position.

After the cornerboard 452 is folded, cornerboard gripper 470 and now folded cornerboard 452 move linearly and horizontally along transfer arm 480 to the mounted end 481*b* of transfer arm 480. After cornerboard gripper 470 and cornerboard 452 reach end 481*b* of transfer arm 480, transfer arm 480 rotates 180 degrees, positioning cornerboard 452 such that the first leg 454 of cornerboard 452 is perpendicular to the longitudinal axis 451 of the magazine 450 and the second leg 456 of cornerboard 452 is parallel to the longitudinal axis 451 of magazine 450.

After rotation, transfer arm 480 moves with cornerboard gripper 470, which is holding cornerboard 452, along shaft 482, parallel to longitudinal axis 451 of magazine 450 and toward load 410 until a sensor senses that the first leg 454 of the cornerboard 452 is proximate a front face (side of load facing magazine 450 and perpendicular to longitudinal axis 451 of magazine 450) of the load 410. Once the sensor senses proximity to the front face of load 410, transfer arm 480 stops moving. Cornerboard gripper 470 then begins to move linearly and horizontally along transfer arm 480 toward free end 481*a* until another sensor senses that the second leg 456 of cornerboard 452 is proximate a side face (side of load parallel to longitudinal axis 451 of magazine 450 and adjacent to drive shaft 482) of load 410. Once proximity to the side face of the load 410 is sensed, cornerboard gripper 470 stops moving along transfer arm 480. At this point, the first leg 454 of cornerboard 452 is proximate the front surface of the load 410 and the second leg 456 is proximate the side face of the load 410. A top platen 490 may already be resting on top of load 410 or may now come to rest on top of load 410. An arm of the top platen 490 is actuated to move from a non-engaging position to an engaging position, bringing a hand or panel into contact with cornerboard 452, holding cornerboard 452 in place against load 410.

Once the cornerboard 452 is secured to the corner of the load by a hand or panel, suction cups 474 of cornerboard gripper 470 release cornerboard 452. Turntable 420 rotates a quarter of a revolution, such that the load 410 is rotated 90 degrees from its original position, and is ready to receive another cornerboard. Cornerboard gripper 470 then moves linearly and horizontally along transfer arm 480 toward mounted end 481*b*. Transfer arm 480 then rotates 180 degrees. After rotation, transfer arm 480 moves along shaft 482 toward magazine 450 and cornerboard gripper 470 then moves to the free end 481*a* of transfer arm 480 and unfolds into its open or flat position. Cornerboard gripper 470 moves into magazine 450 and secures a second cornerboard 452*a*. The process described above is repeated until cornerboard 452*a* is secured to the load by another hand or panel. This process is repeated two more times, as third and forth cornerboards 452*b*, 452*c*, are placed on the load 410. Once four cornerboards have been secured to the load, turntable 420 rotates to provide relative rotation between load 410 and packaging material dispenser 402 to wrap packaging material 414 around the load. The turntable continues to rotate until load 410 is completely wrapped in packaging material 414, and top platen 490 rotates with the load 410 about shaft 492.

Alternatively, the apparatus 400 may not be provided with a clamp 490 to facilitate folding/bending of unformed cornerboards 452. In such an embodiment, the method of use would be substantially the same, except that the bending/folding of the cornerboard 452 would be caused solely by moving the cornerboard gripper 470 from the open/flat position to the folded/closed position. It would be necessary to ensure that the suction cups 474 apply sufficient suction to the cornerboard to prevent it from slipping during folding. In addition, it would be preferable that the hinge of the cornerboard gripper 470 be aligned with any scoring or perforations in the unformed cornerboard, and that the scoring/perforations be sufficient to assist in folding the unformed cornerboard.

In another alternative, a clamp 490 may not be provided and gripper 470 may not move between a flat position and a folded position. Each unformed cornerboard 452 could be transported to a side of the load as previously described with respect to FIGS. 12 and 13. However, the cornerboard would have to be pressed against the side of the load upstream of and parallel to the film path. In this manner, as the packaging material is wrapped around the load, it would secure one leg of the cornerboard 352 to the load. Then, as the packaging material moved around the corner of the load, it would engage the portion of the cornerboard 352 (other leg) in its film path and pull the other leg into contact with the other side of the corner of the load, forming the cornerboard 352 and securing it to the load at the same time.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of wrapping a load with packaging material, comprising:

providing a load on a load transport surface;

providing at least one magazine containing unformed cornerboards;

removing a cornerboard from within the magazine with a gripper;

folding the cornerboard with the gripper;

transporting the cornerboard to a corner of the load with the gripper subsequent to folding the cornerboard;

dispensing packaging material from a packaging material dispenser; and moving the packaging material dispenser and the load relative to one another to wrap the packaging material around the cornerboard and load.

2. The method of claim 1, wherein gripping the cornerboard with the gripper includes applying a vacuum to the cornerboard.

3. The method of claim 1, wherein folding the cornerboard includes actuating a clamp to hold a portion of the cornerboard stationary as another portion of the cornerboard is moved relative to the clamp with the gripper, thereby folding the cornerboard.

4. The method of claim 3, wherein the clamp is moved into contact with a portion of the cornerboard having scoring or perforations.

5. The method of claim 3, wherein folding the cornerboard further includes moving the gripper holding the cornerboard from a flat position to a folded position.

6. The method of claim 1, wherein folding the cornerboard includes moving the gripper from a flat position to a folded position.

7. The method of claim 1, wherein transporting the cornerboard includes moving the cornerboard in a direction parallel to a longitudinal axis of the load transport surface until a first leg of the cornerboard is proximate a first side of a corner of the load.

8. The method of claim 7, wherein transporting the cornerboard further includes moving the cornerboard in a direction transverse to the longitudinal axis of the load transport surface until a second leg of the cornerboard is proximate a second side of the corner of the load.

9. The method of claim 1, wherein providing the load includes moving the load on a conveyor.

10. The method of claim 1, further comprising rotating the cornerboard approximately 180 degrees prior to transporting.

11. The method of claim 8, wherein moving the cornerboard in a direction parallel to the longitudinal axis of the load transport surface includes actuating a first drive.

12. The method of claim 7, wherein moving the cornerboard in a direction parallel to the longitudinal axis of the load transport surface includes sensing the first side of the load.

13. The method of claim 11, wherein moving the cornerboard in a direction perpendicular to the longitudinal axis of the load transport surface includes actuating a second drive.

14. The method of claim 8, wherein moving the cornerboard in a direction perpendicular to the longitudinal axis of the load transport surface includes sensing the second side of the load.

15. A method of wrapping a load with packaging material, comprising:

providing a load on a load transport surface;

holding an unformed cornerboard with a gripper;

folding the unformed cornerboard with the gripper;

transporting the folded cornerboard with the gripper in a direction parallel to a longitudinal axis of the load transport surface until a first leg of the cornerboard is proximate a first side of a corner of the load;

transporting the folded cornerboard with the gripper in a direction transverse to the longitudinal axis of the load transport surface until a second leg of the cornerboard is proximate a second side of the corner of the load;

dispensing packaging material from a packaging material dispenser; and wrapping the packaging material around the cornerboard and load.

16. The method of claim 15, wherein folding the unformed cornerboard includes moving the gripper from a flat position to a folded position.

17. The method of claim 16, wherein moving the gripper includes rotating a first wall portion of the gripper with respect to a second wall portion of the gripper such that the wall portions form a angle of about 90 degrees.

18. The method of claim 16, wherein folding the unformed cornerboard further comprises actuating a clamp to hold a portion of the cornerboard stationary as another portion of the cornerboard is moved relative to the clamp with the gripper, thereby folding the cornerboard.

19. The method of claim 18, wherein the clamp contacts the unformed cornerboard at a portion of the cornerboard having scoring or perforations.

20. A method of wrapping a load with packaging material, comprising:

providing at least one magazine containing cornerboards;

moving a gripper and an unformed cornerboard out of a magazine for storing unformed cornerboards;

folding the unformed cornerboard;

transporting folded cornerboard to a corner of the load with the gripper;

dispensing packaging material from a packaging material dispenser; and providing relative movement between the packaging material dispenser and the load to wrap the packaging material around the cornerboard and load.

21. An apparatus for wrapping a load with packaging material, comprising:

a packaging material dispenser for dispensing packaging material;

at least one magazine for containing unformed cornerboards;

a cornerboard gripper having first and second wall portions connected by a hinge, the first and second wall portions being movable between a flat position and a folded position, the cornerboard gripper being configured to fold an unformed cornerboard and transport the folded cornerboard to a position proximate a corner of the load;

a first drive for moving the first and second wall portions of the gripper between the flat position and the folded position to fold the unformed cornerboard;

a clamp movable between a retracted position and an extended position;

a second drive for moving the clamp between the retracted position and the extended position, wherein the unformed cornerboard is between the gripper and the clamp when the clamp is in the extended position; and means for wrapping the packaging material around the cornerboard and load.

22. The apparatus of claim 21, further comprising a load transport surface having a longitudinal axis.

23. The apparatus of claim 22, wherein the gripper is movable in a first direction perpendicular to the longitudinal axis of the load transport surface.

24. The apparatus of claim 23, further comprising a transport arm supporting the gripper and movable in a second direction parallel to the longitudinal axis of the load transport surface.

* * * * *

UNITED STATES PATENT AND TRADEMARK OFFICE

CERTIFICATE OF CORRECTION

PATENT NO. : 6,990,784 B2
DATED : January 31, 2006
INVENTOR(S) : Patrick R. Lancaster, III et al.

It is certified that error appears in the above-identified patent and that said Letters Patent is hereby corrected as shown below:

Column 29,
Line 43, "a angle" should read -- an angle --.

Signed and Sealed this

Eleventh Day of April, 2006

JON W. DUDAS
*Director of the United States Patent and Trademark Office*